US009168766B2

(12) United States Patent
Terada

(10) Patent No.: US 9,168,766 B2
(45) Date of Patent: Oct. 27, 2015

(54) RECORDING APPARATUS

(71) Applicant: Kohei Terada, Ichinomiya (JP)

(72) Inventor: Kohei Terada, Ichinomiya (JP)

(73) Assignee: Brother Kogyo Kabushiki Kaisha, Nagoya-shi, Aichi-ken ( * ) Notice: Subject to any disclaimer, the term of this patent is extended or adjusted under 35 U.S.C. 154(b) by 0 days.

(21) Appl. No.: 14/217,648

(22) Filed: Mar. 18, 2014

(65) Prior Publication Data

US 2014/0292973 A1 Oct. 2, 2014

(30) Foreign Application Priority Data

Mar. 29, 2013 (JP) ..... 2013-075172

(51) Int. Cl.

| | |
|---|---|
| ***B41J 11/00*** | (2006.01) |
| ***B41J 3/54*** | (2006.01) |
| ***B41J 29/02*** | (2006.01) |
| ***B41J 13/00*** | (2006.01) |
| ***B41J 29/38*** | (2006.01) |

(52) U.S. Cl.

CPC ..... *B41J 11/007* (2013.01); *B41J 3/543* (2013.01); *B41J 13/009* (2013.01); *B41J 29/023* (2013.01); *B41J 29/38* (2013.01)

(58) Field of Classification Search

CPC ..... B41J 11/007; B41J 3/543; B41J 29/38; B41J 13/009; B41J 29/023

USPC ..... 347/104

See application file for complete search history.

(56) References Cited

U.S. PATENT DOCUMENTS

| | | | | |
|---|---|---|---|---|
| 5,208,640 | A * | 5/1993 | Horie et al. | 399/110 |
| 2003/0029339 | A1 | 2/2003 | Silverbrook | |
| 2005/0056177 | A1 * | 3/2005 | Silverbrook | 101/424.1 |

FOREIGN PATENT DOCUMENTS

| | | |
|---|---|---|
| CN | 1907721 | 2/2007 |
| JP | 2005-053016 | 3/2005 |
| JP | 2005-165112 | 6/2005 |
| JP | 2006-225061 | 8/2006 |

OTHER PUBLICATIONS

Extended European Search Report for Application No. 14159827.6-1701 dated Aug. 6, 2014.

Notification of First Office Action for Chinese Application No. 2014/10087708.5 dated Jun. 2, 2015.

* cited by examiner

*Primary Examiner* — Manish S Shah
*Assistant Examiner* — Roger W Pisha, II
(74) *Attorney, Agent, or Firm* — Frommer Lawrence & Haug LLP

(57) ABSTRACT

A recording apparatus including recording modules each having a recording medium conveyance path, the modules being identical in external shape and disposed such that conveyor surfaces thereof are parallel to each other and such that same-shaped portions thereof align with each other in a first direction intersecting the conveyor surface, wherein, in a certain cross section orthogonal to the conveyor surface and parallel to the first direction, where a dimension of each module in a second direction orthogonal to a conveyor surface is L1 and a dimension thereof in a third direction orthogonal to the second direction is L2, a dimension L3, in the second direction, of adjacent two of the modules in the first direction is smaller than twice the dimension L1 and a dimension L4, in the third direction, of the adjacent two modules is smaller than twice the dimension L2 and is larger than the dimension L2.

8 Claims, 18 Drawing Sheets

RECORDING APPARATUS

CROSS REFERENCE TO RELATED APPLICATION

The present application claims priority from Japanese Patent Application No. 2013-075172, which was filed on Mar. 29, 2013, the disclosure of which is herein incorporated by reference in its entirety.

BACKGROUND OF THE INVENTION

1. Field of the Invention

The present invention relates to a recording apparatus configured to record an image.

2. Description of Related Art

There is known a printer (recording apparatus) having a plurality of printing units disposed in parallel. When a large amount of printed matter is produced, for instance, the printing units are operated in parallel, so as to achieve high-speed printing. In the printer, the plurality of printing units are stacked on each other in the height direction of the printer. Each printing unit has: a conveyance path in which a recording sheet is conveyed; and a printing portion having an ink-jet head for recording an image on the recording sheet. The recording sheet on which an image has been recorded is discharged to a sheet-discharge tray.

SUMMARY OF THE INVENTION

The printer described above is constituted by the plurality of printing units that are merely stacked on each other in the height direction of the printer. Where the printing units are thus stacked, the height of the printer is inevitably increased. Even if each printing unit is configured to have only the printing portion for the purpose of reducing the height of the printing unit, the height of the printer is equal to an amount obtained by multiplying a maximum thickness (in the height direction of the printer) of one printing unit (printing portion) by the number of the printing units. Accordingly, there is a problem of an increase in the size of the printer in the height direction.

It is therefore an object of the present invention to provide a recording apparatus having a reduced size even if the recording apparatus is equipped with a plurality of recording modules.

The object indicated above may be attained according to a principle of the invention, which provides a recording apparatus comprising a plurality of recording modules each having a conveyance path through which a recording medium is conveyed and a recording portion configured to record an image on the recording medium that is conveyed along the conveyance path, wherein the recording modules are identical in external shape, wherein, where an imaginary plane on which the recording medium is conveyed in the conveyance path is defined as a conveyor surface and a direction which is parallel to the conveyor surface and in which the recording medium is conveyed in the conveyance path is defined as a conveyance direction, the recording modules are disposed such that the conveyor surfaces of the respective recording modules are parallel to each other and such that portions of the respective recording modules align with each other in a first direction which intersects the conveyor surface and which includes a component of the conveyance direction, the portions having the same shape, and wherein, in a certain cross section that is orthogonal to the conveyor surface and that is parallel to the first direction, where a dimension of each recording module in a second direction orthogonal to the conveyor surface is L1 and a dimension of each recording module in a third direction orthogonal to the second direction is L2, a dimension L3, in the second direction, of two recording modules among the plurality of recording modules that are adjacent in the first direction is smaller than twice the dimension L1 and a dimension L4, in the third direction, of the two recording modules is smaller than twice the dimension L2 and is larger than the dimension L2.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be described embodiments of the invention with reference to the drawings.

Figure 1:
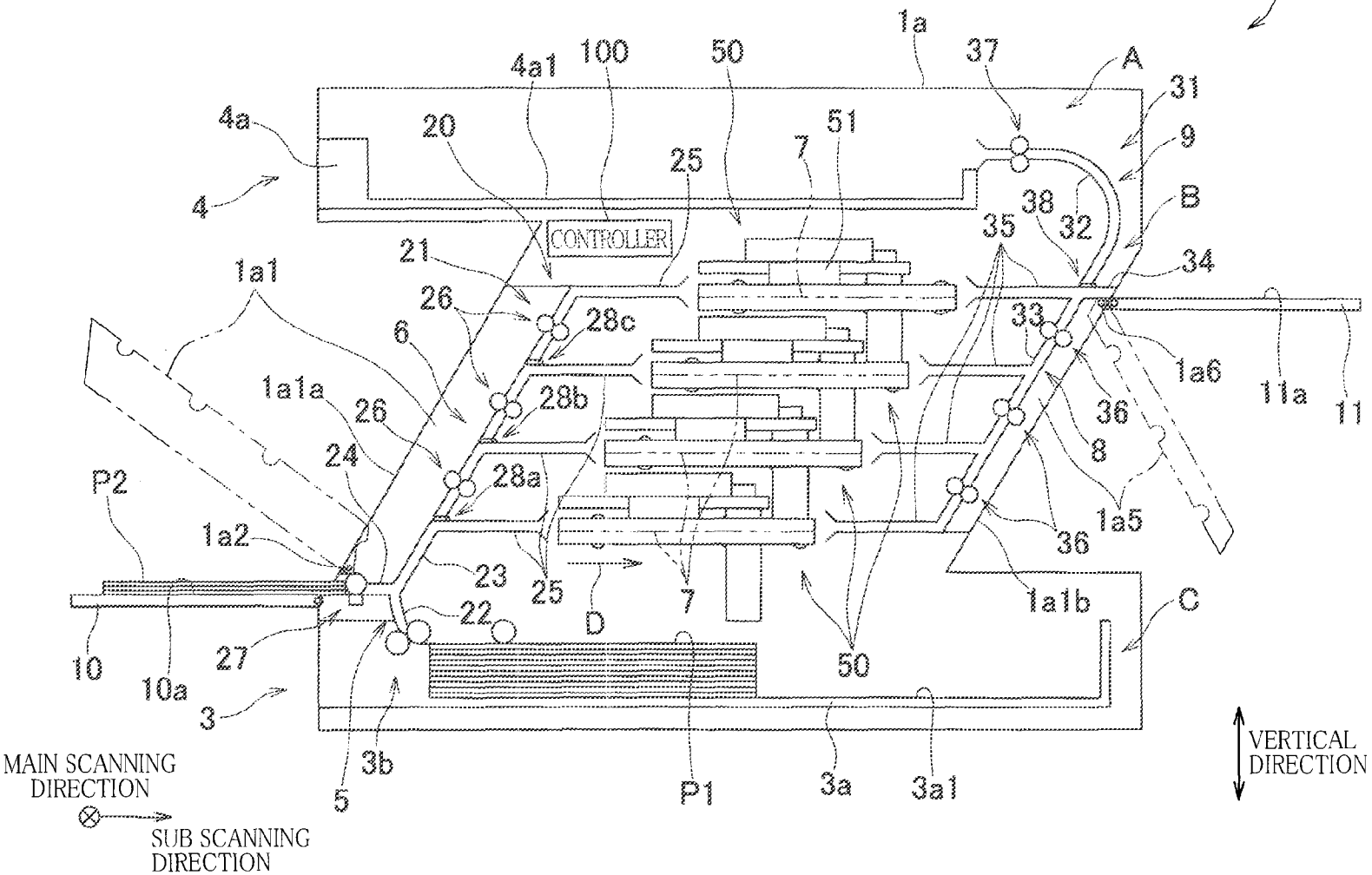
FIG. 1 is a schematic side view showing an internal structure of an ink-jet printer as a recording apparatus according to one embodiment of the invention.

Referring first to FIG. 1, there will be explained an overall configuration of an ink-jet printer 1 as one example of a recording apparatus according to one embodiment of the invention.

The printer 1 has a housing 1*a* having a Z-shaped cross section. An internal space of the housing 1*a* is divided into spaces A, B, and C in order from the top of the housing 1*a*. In the space A, a first sheet-discharge portion 4 and a downstream curved path 9 are formed. In the space C, a first sheet-supply portion 3 and an upstream curved path 5 are formed. In the housing 1*a*, a second sheet-supply tray 10 and a second sheet-discharge tray 11 are disposed. In the space B, there are formed an upstream conveyance path 6, four intermediate conveyance paths 7 and a downstream conveyance path 8 that extend from the first sheet-supply portion 3 or the second sheet-supply tray 10 toward the first sheet-discharge portion 4 or the second sheet-discharge tray 11. A sheet P1 supplied from the first sheet-supply portion 3 passes through the upstream curved path 5, the upstream conveyance path 6, one of the intermediate conveyance paths 7, the downstream conveyance path 8, and the downstream curved path 9 and is finally discharged to the first sheet-discharge portion 4. A sheet P2 supplied from the second sheet-supply tray 10 passes through the upstream conveyance path 6, one of the intermediate conveyance paths 7, and the downstream conveyance path 8, and is finally discharged to the second sheet-discharge tray 11. In the space B, image recording is performed on the sheet P1, P2 in each intermediate conveyance path 7.

In the space B, there are disposed four recording units 50, a conveyor portion 20, a controller 100, and so on. Each recording unit 50 includes a head 51 of a serial type and the intermediate conveyance path 7. In the space B, there are further disposed four cartridges not shown. Each of the cartridges stores black ink. Each cartridge is connected to a corresponding one of the heads 51 via a tube and a pump (both of which are not shown), and the ink in the cartridge is supplied to the corresponding head 51. While the head 51 in the present embodiment is a monochrome head, a color head may be employed as the head 51. In this instance, the cartridges store color ink.

The conveyor portion 20 includes an upstream guide portion 21 and a downstream guide portion 31. The upstream guide portion 21 includes three guides 22-24, four guides 25, three conveyance roller pairs 26, a sheet-supply mechanism 27, and three switching mechanisms 28*a*-28*c*. The upstream guide portion 21 connects each recording unit 50 to the first sheet-supply portion 3 and the second sheet-supply tray 10. A conveyance motor 26M (FIG. 12) is driven under the control of the controller 100, whereby the three conveyance roller pairs 26 are rotated so as to convey the sheets P1, P2 to the recording units 50. The upstream conveyance path 6 is defined by the three guides 22-24 and the four guides 25.

The downstream guide portion 31 includes three guides 32-34, four guides 35, three conveyance roller pairs 36, a conveyance roller pair 37, and a switching mechanism 38. The downstream guide portion 31 connects each recording unit 50 to the first sheet-discharge portion 4 and the second sheet-discharge tray 11. Conveyance motors 36M, 37M (FIG. 12) are driven under the control of the controller 100, whereby the three conveyance roller pairs 36 and the conveyance roller pair 37 are rotated so as to convey sheet P to the first sheet-discharge portion 4 or the second sheet-discharge tray 11. The downstream conveyance path 8 is defined by the three guides 32-34 and the four guides 35.

The first sheet-supply portion 3 disposed in the space C includes a first sheet-supply tray 3*a* and a sheet-supply mechanism 3*b*. The first sheet-supply tray (as one example of a first common tray) 3*a* is attachable to and detachable from the housing 1*a* in a sub scanning direction, thereby enabling a user to easily replenish the first sheet-supply portion 3 with the sheets P1. In the first sheet-supply tray 3*a* of the present embodiment, the sheets P1 such as plain paper are accommodated, for instance. The first sheet-supply tray 3*a* is a box opening upward and has a support surface 3*a*1 on which a plurality of sheets P1 are supported. Thus, the first sheet-supply tray 3*a* is configured to accommodate a large amount of sheets P1. In the present embodiment, the first sheet-supply tray 3*a* can accommodate a larger amount of sheets P than the second sheet-supply tray 10.

In a state in which the first sheet-supply tray 3*a* is attached to the housing 1*a*, the first sheet-supply tray 3*a* partially overlaps all of the recording units 50 as viewed from the top or the bottom of the printer in the vertical direction (FIG. 8), namely, in a vertical-direction view. In other words, the first sheet-supply tray 3*a* and all of the recording units 50 have respective portions that are located at the same position in the sub scanning direction (sheet conveyance direction D). In the arrangement, it is possible to reduce the size of the printer 1 in the sub scanning direction with an increase in overlapping portions of all of the recording units 50 and the first sheet-supply tray 3*a*. When the first sheet-supply tray 3*a* is attached to the housing 1*a*, the center, in the main scanning direction, of the sheets P1 supported on the support surface 3*a*1 is located at substantially the same position as the center, in the main scanning direction, of the intermediate conveyance path 7 of each recording unit 50. Accordingly, the center, in the main scanning direction, of the sheet P1 conveyed from the first sheet-supply tray 3*a* to each recording unit 50 is easily positioned with respect to the recording unit 50 in the main scanning direction. Therefore, it is possible to reduce a margin (positional margin) that is allowed for the width of the recording unit 50 in the main scanning direction with respect to the width of the sheet P1 in the main scanning direction, thereby minimizing the size of the printer 1. The sheet-supply mechanism 3*b* is configured to supply an uppermost one of the sheets P1 in the first sheet-supply tray 3*a* to the upstream curved path 5.

The first sheet-discharge portion 4 disposed in the space A includes a first sheet-discharge tray 4*a*. The first sheet-discharge tray (as one example of the first common tray) 4*a* is attachable to and detachable from the housing 1*a* in the sub scanning direction. The first sheet-discharge tray 4*a* is a box opening upward and has a support surface 4*a*1 on which a plurality of sheets P1 are supported. Thus, the first sheet-discharge tray 4*a* is configured to accommodate a large amount of sheets P1. In the present embodiment, the first sheet-discharge tray 4*a* can accommodate a larger amount of sheets P1 than the second sheet-discharge tray 11. In a state in which the first sheet-discharge tray 4*a* is attached to the housing 1*a*, the first sheet-discharge tray 4*a* partially overlaps all of the recording units 50 in the vertical-direction view, like the first sheet-supply tray 3*a*. In other words, the first sheet-discharge tray 4*a* and all of the recording units 50 have respective portions that are located at the same position in the sub scanning direction (sheet conveyance direction D). Accordingly, it is possible to reduce the size of the printer 1 in the sub scanning direction with an increase in overlapping portions of all of the recording units 50 and the first sheet-discharge tray 4*a*. When the first sheet-discharge tray 4*a* is attached to the housing 1*a*, the center, in the main scanning direction, of the sheets P1 supported on the support surface 4*a*1 is located at substantially the same position as the center, in the main scanning direction, of the intermediate conveyance path 7 of each recording unit 50. Accordingly, the centers, in the main scanning direction, of the sheets P1 discharged from the recording units 50 to the first sheet-discharge tray 4*a* are easily aligned with one another.

Here, the sub scanning direction is a direction parallel to the sheet conveyance direction D in which the sheets P are conveyed by conveyance roller pairs 52-54 (which will be explained), and the main scanning direction is a direction parallel to the horizontal plane and orthogonal to the sub scanning direction.

Figure 12:
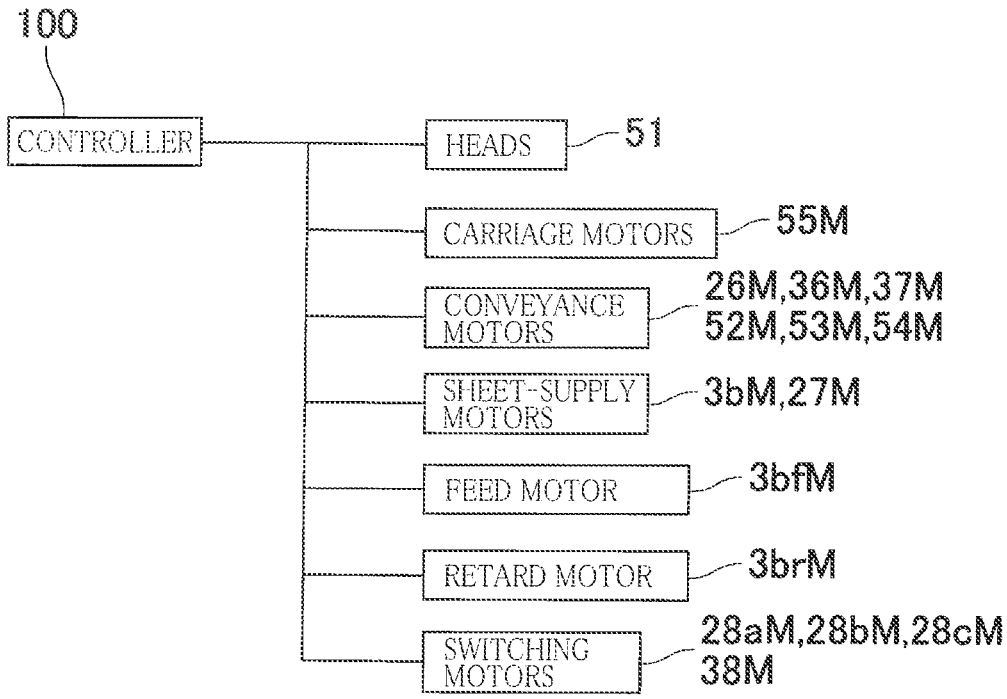
FIG. 12 is a block diagram showing an electric structure of the printer.

The controller 100 will be explained. The controller 100 controls a recording operation on the basis of a recording command sent from an external device such as a personal computer (PC) connected to the printer 1. More specifically, the controller 100 controls a conveyance operation of the sheet P, an ink ejection operation that is synchronized with conveyance of the sheet P, and so on. The controller 100 includes a Central Processing Unit (CPU) that is an arithmetic processing unit, a Read Only Memory (ROM), a Random Access Memory (RAM including a non-volatile RAM), an Application Specific Integrated Circuit (ASIC), an Interface (I/F), an Input/Output Port (I/O), and so on. In the ROM, programs executed by the CPU, fixed data, and the like are stored. In the RAM, data (image data or the like) necessary when the programs are executed are temporarily stored. The ASIC performs rewriting, sorting, and the like, of image data, such as signal processing and image processing. The I/F performs transmission and reception of data with the external device. The I/O performs input/output of detection signals of various sensors. As shown in FIG. 12, the controller 100 is connected to the heads 51, carriage motors 55M, conveyance motors 26M, 36M, 37M, 52M-54M, sheet-supply motors 3*b*M, 27M, a feed motor 3*bf*M, a retard motor 3*br*M, and switching motors 28*a*M-28*c*M,38M.

When the controller 100 receives, from the external device, a recording command for performing recording on a plurality of sheets P, the controller 100 drives, based on the recording command, the sheet-supply motor 3*b*M of the sheet-supply mechanism 3*b* or the sheet-supply motor 27M of the sheet-supply mechanism 27 and the conveyance motors 26M, 36M of the conveyance roller pairs 26, 36, for permitting the sheets P to be conveyed from the first sheet-supply tray 3*a* or the second sheet-supply tray 10. When the sheets P1 set in the first sheet-supply tray 3*a* are conveyed, the sheet-supply mechanism 3*b* is driven according to tray selection information included in the recording command sent from the external device, so that the sheets P1 are supplied from the first sheet-supply tray 3*a*. When the sheets P2 set in the second sheet-supply tray 10 are conveyed, the sheet-supply mechanism 27 is driven according to tray selection information included in the recording command sent from the external device, so that the sheets P2 are supplied from the second sheet-supply tray 10. In the present embodiment, sheets that are thin and have low resilience, such as plain paper, are placed on the first sheet-supply tray 3*a* while sheets that are thicker and have higher resilience than the plain paper, such as thick paper, business cards, and postcards, are placed on the second sheet-supply tray 10.

The controller 100 also controls the switching motors 28*a*M-28*c*M of the respective three switching mechanisms 28*a*-28*c*, in accordance with the recording unit 50 by which an image is recorded on the sheet P. That is, when image recording is performed by the uppermost one of the recording units 50, all of three path switching portions 28*a*1, 28*b*1, 28*c*1 are disposed at respective block positions (that will be explained). When image recording is performed by the second one of the recording units 50 form the top, the path switching portions 28*a*1, 28*b*1 are disposed at the respective block positions while the path switching portion 28*c*1 is disposed at a guide position (that will be explained). When image recording is performed by the third one of the recording units 50 form the top, the path switching portion 28*a*1 is disposed at the block position while the path switching portion 28*b*1 is disposed at the guide position. When image recording is performed by the fourth one of the recording units 50 from the top, namely, the lowermost one of the recording units 50, the path switching portion 28*a*1 is disposed at the guide position.

When an image is recorded on the sheet P that has been conveyed, the head 51 and the carriage motor 55M of a carriage 55 in a corresponding one of the recording units 50 are driven and the conveyance motors 52M-54M of the respective conveyance roller pairs 52-54 (that will be explained) are also driven. Thus, an image is recorded on the sheet P conveyed by the conveyance roller pairs 52-54. The sheet P on which an image has been recorded is discharged to the first sheet-discharge portion 4 or the second sheet-discharge tray 11, depending upon from which one of the first sheet-supply tray 3*a* and the second sheet-supply tray 10 the sheet P has been supplied. That is, when the sheet P is supplied from the first sheet-supply tray 3*a*, the controller 100 controls the switching motor 38M of the switching mechanism 38 such that a path switching portion 38*a* is disposed at a first sheet-discharge position as described below. In this instance, the controller 100 also drives the conveyance motor 37M of the conveyance roller pair 37. Thus, the sheet P1 which has been supplied from the first sheet-supply tray 3*a* and on which an image has been recorded is discharged to the first sheet-discharge portion 4. When the sheet P2 is supplied from the second sheet-supply tray 10, the controller 100 drives the switching motor 38M of the switching mechanism 38 such that the path switching portion 38*a* is disposed at a second sheet-discharge position as described below. Thus, the sheet P2 which has been supplied from the second sheet-supply tray 10 and on which an image has been recorded is discharged to the second sheet-discharge tray 11.

Figure 2:
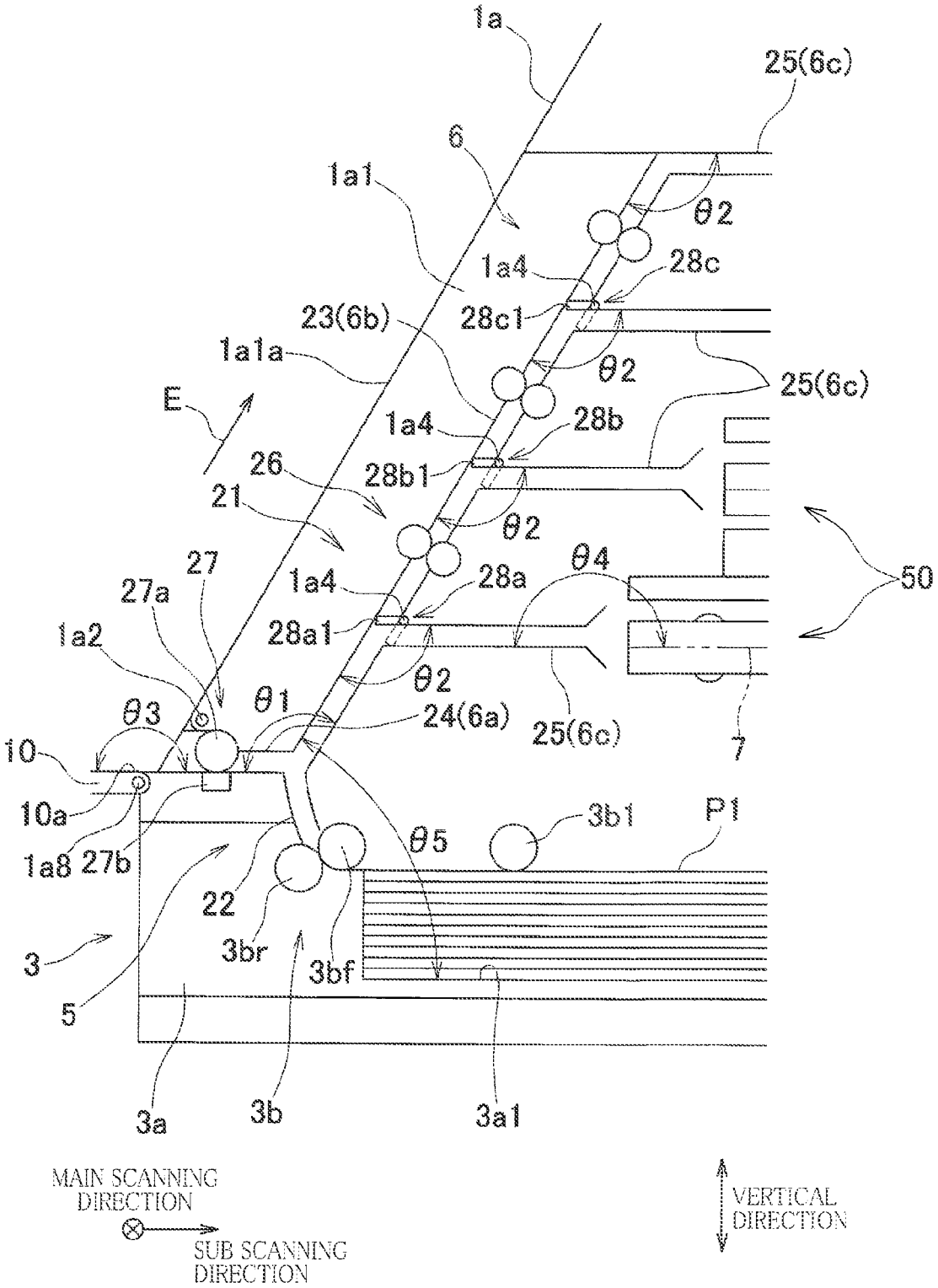
FIG. 2 is a partially enlarged view of the printer shown in FIG. 1.

Referring next to FIG. 2, the upstream guide portion 21 of the conveyor portion 20 will be explained in detail. The guide 22 of the upstream guide portion 21 is formed generally in an arc extending from the sheet-supply mechanism 3*b* toward a lower end of the guide 23. That is, the upstream curved path 5 is defined by the guide 22 that connects the first sheet-supply portion 3 and the guide 23.

The upstream conveyance path (as one example of a connection path) 6 is constituted by an upstream first path 6*a*, an upstream inclined path 6*b*, and four upstream second paths 6*c*. The guide 23 obliquely extends in an upper right direction in FIG. 2, namely, extends in a direction E (as one example of a first direction), so as to define the upstream inclined path 6*b*. In other words, the upstream inclined path 6*b* extends in a direction that intersects the intermediate conveyance path 7 of each recording unit 50. The guide 23 is disposed at a position at which the guide 23 is partially opposed to all of the recording units 50 in the sub scanning direction. The guide 24 extends in a direction parallel to the sub scanning direction in FIG. 2 and is connected to the lower end of the guide 23. That is, the upstream first path 6*a* is defined by the guide 24 that connects the second sheet-supply tray 10 and the guide 23, and extends in the sub scanning direction. The guide 24 is disposed on one of opposite sides of the guide 23 that is remote from the recording units 50.

Each of the four guides 25 extends in the direction parallel to the sub scanning direction in FIG. 2 and connects the guide 23 and an upstream end of a corresponding one of the intermediate conveyance paths 7. That is, each of the four upstream second paths 6*c* is defined by a corresponding one of the guides 25 that connects the guide 23 and the upstream end of the corresponding one of the intermediate conveyance paths 7. The four upstream second paths 6*c* extend in the sub scanning direction. The four guides 25 are disposed so as to be equally spaced apart from each other in the vertical direction. The guides 25 are disposed on the other of the opposite sides of the guide 23 that is remote from the guide 24. The uppermost one of the four guides 25 is connected to an upper end of the guide 23. The lowermost one of the four guides 25 is connected to the guide 23 at a position higher than the guide 24.

The guide 23 is inclined such that an angle θ1 formed by the guide 24 and the guide 23 and an angle θ2 formed by each guide 25 and the guide 23 are the same obtuse angle. In other words, all of the upstream first path 6*a* and the four upstream second paths 6*c* extend in the sub scanning direction, and the upstream inclined path 6*b* is inclined to form the obtuse angle with respect to the upstream first path 6*a* and the four upstream second paths 6*c*. Here, the angle θ2 is an angle formed by: a portion of the guide 23 (the upstream inclined path 6*b*) that is located more upstream than each guide 25; and each guide 25 (the upstream second path 6*c*). The angle θ1 is an angle formed by: a portion of the guide 23 that is located more downstream than the guide 24; and the guide 24 (the upstream first path 6*a*).

The guide 24 (the upstream first path 6*a*) and a support surface 10*a* of the second sheet-supply tray 10 are linearly connected, and an angle θ3 formed by the guide 24 and the support surface 10*a* is 180°, as shown in FIG. 2. Each of the guides 25 (the upstream second path 6*c*) and a corresponding one of the intermediate conveyance paths 7 are linearly connected. That is, an angle θ4 formed by the upstream second path 6*c* and the intermediate conveyance path 7 is also 180°. While the angles θ3, θ4 are 180° in the present embodiment, each of the angles θ3, θ4 may be an obtuse angle.

In the present embodiment, the angles θ1-θ4 are set so as to be larger than 90° and not larger than 180°. Accordingly, when the sheet P is conveyed from the second sheet-supply tray 10 to each intermediate conveyance path 7, a maximum bending angle of the sheet P at each of angular portions (i.e., a connecting portion of the second sheet-supply tray 10 and the upstream first path 6*a*, a connecting portion of the upstream first path 6*a* and the upstream inclined path 6*b*, a connecting portion of the upstream inclined path 6*b* and each upstream second path 6*c*, and a connecting portion of each upstream second path 6*c* and each intermediate conveyance path 7) is less than 90°. (Where an angle of a sheet in a state in which the sheet is not bent in a straight conveyance path is defined as 180° and a bending angle of the sheet in that state is defined as 0°, the bending angle of the sheet is an acute angle when an angle of the conveyance path is larger than 90° and is not larger than 180° because the angle of the conveyance path and the bending angle of the sheet are supplementary angles.) Further, even where the sheet P2 is conveyed from the second sheet-supply tray 10 to the intermediate conveyance path 7, there exist, within the length of the sheet P2, no path in which the sheet P2 is bent in the same direction by 90° or more in total. That is, when the sheet P2 is conveyed from the second sheet-supply tray 10 to the lowermost recording unit 50, one sheet P2 is bent in opposite directions at each connecting portion even where some mid portion of the one sheet P2 is located at the connecting portion of the upstream first path 6*a* and the upstream inclined path 6*b* at a time point when the leading end of the one sheet P2 passes the connecting portion of the upstream inclined path 6*b* and the upstream second path 6*c*. Therefore, the one sheet P2 is not bent in the same direction by 90° or more.

An angle θ5 formed by the guide 23 and the support surface 3*a*1 of the first sheet-supply tray 3*a* is an acute angle as shown in FIG. 2. By thus forming the guide 23 and the first sheet-supply tray 3*a*, the guide 23 and the first sheet-supply tray 3*a* can be disposed overlappingly in the vertical-direction view, thereby ensuring size reduction of the printer 1. In this respect, the sheet P1 conveyed from the first sheet-supply tray 3*a* to the upstream inclined path 6*b* is bent by 90° or more. However, the first sheet-supply tray 3*a* is for accommodating plain paper (such as the sheet P1 that is thinner and easy to bent as compared with thick paper). Accordingly, even where the sheet P1 is bent by 90° or more, there is no influence on sheet conveyance.

The three switching mechanisms 28*a*-28*c* respectively have the path switching portions 28*a*1, 28*b*1, 28*c*1 and the switching motors 28*a*M, 28*b*M, 28*c*M. The path switching portions 28*a*1, 28*b*1, 28*c*1 are pivotally supported by respective pins 1*a*4 provided on the housing 1*a*. The switching motors 28*a*M, 28*b*M, 28*c*M are driven under the control of the controller 100, whereby the path switching portions 28*a*1, 28*b*1, 28*c*1 are placed selectively at one of the guide position and the block position. At the guide position, the distal end of each path switching portion 28*a*1, 28*b*1, 28*c*1 is in contact with the guide 23, as shown in FIG. 2. When the path switching portion 28*a*1 is located at the guide position, a portion of the upstream inclined path 6*b* up to the path switching portion 28*a*1 communicates with the upstream second path 6*c* that is connected to the intermediate conveyance path 7 of the lowermost recording unit 50. When the path switching portion 28*b*1 is located at the guide position, a portion of the upstream inclined path 6*b* up to the path switching portion 28*b*1 communicates with the upstream second path 6*c* that is connected to the intermediate conveyance path 7 of the third recording unit 50 from the top. When the path switching portion 28*c*1 is located at the guide position, a portion of the upstream inclined path 6*b* up to the path switching portion 28*c*1 communicates with the upstream second path 6*c* that is connected to the intermediate conveyance path 7 of the second recording unit 50 from the top. At the block position, the distal end of each path switching portion 28*a*1, 28*b*1, 28*c*1 is in contact with the guide 25, as indicated by the dashed line in FIG. 2. At the block position, communication between the upstream inclined path 6*b* and the upstream second path 6*c* that is in contact with a corresponding one of the path switching portions 28*a*1, 28*b*1, 28*c*1 is interrupted. When all of the path switching portions 28*a*1, 28*b*1, 28*c*1 are located at the respective block positions, the upstream inclined path 6*b* communicates with the upstream second path 6*c* that is connected to the intermediate conveyance path 7 of the uppermost recording unit 50.

As shown in FIG. 2, the sheet-supply mechanism 27 is provided at the connecting portion of the second sheet-supply tray 10 and the upstream first path 6*a* and has a sheet-supply roller 27*a*, a friction plate 27*b*, and the sheet-supply motor 27M (FIG. 12). The friction plate 27*b* is disposed below the sheet-supply roller 27*a* so as to be opposed to the sheet-supply roller 27*a*. The sheet-supply roller 27*a* comes into contact with an upper surface of an uppermost one of the sheets P2 supported by the second sheet-supply tray 10. The friction plate 27*b* comes into frictional and sliding contact with a lower surface of the sheet P2 conveyed by the sheet-supply roller 27*a*. The sheet-supply roller 27*a* is configured to rotate counterclockwise in FIG. 2 under the control of the controller 100, so as to send the sheet P2 to the upstream first path 6*a*. The friction plate 27*b* is preferably formed of a member having a high frictional coefficient such as cork or rubber.

In the above arrangement, even if an additional sheet P2 is conveyed together with one sheet P2 such that the additional sheet P2 is held in intimate contact with the lower surface of the one sheet P2 when the one sheet P2 is conveyed to the upstream first path 6*a* by rotation of the sheet-supply roller 27*a* under the control of the controller 100, the additional sheet P2 comes into contact with the friction plate 27*b*. Accordingly, the friction plate 27*b* prevents the additional sheet P2 from being conveyed, so that only one sheet P2 (i.e., the sheet P2 that comes into contact with the sheet-supply roller 27*a*) among a plurality of sheets P2 that have conveyed together is conveyed to the upstream first path 6*a*.

The sheet-supply mechanism 3*b* of the first sheet-supply portion 3 will be explained. As shown in FIG. 2, the sheet-supply mechanism 3*b* includes a sheet-supply roller 3*b*1, a feed roller 3*bf*, a retard roller 3*br*, the sheet-supply motor 3*b*M (FIG. 12), the feed motor 3*b*fM (FIG. 12) and the retard motor 3*b*rM (FIG. 12). The sheet-supply roller 3*b*1 and the feed motor 3*bf*M are provided in the housing 1*a* while the retard roller 3*br* is provided in the first sheet-supply tray 3*a*. The sheet-supply roller 3*b*1 is configured to come into contact with an uppermost one of the sheets P1 supported by the support surface 3*a*1 of the first sheet-supply tray 3*a*. The sheet-supply roller 3*b*1 is connected to the sheet-supply motor 3*b*M and is configured to rotate under the control of the controller 100, thereby feeding the sheet P1.

The feed roller 3*bf* is configured to rotate clockwise (forward direction) in FIG. 2. To the retard roller 3*br*, a torque limiter (not shown) is attached. When one sheet P1 is nipped between the retard roller 3*br* and the feed roller 3*bf*, the retard roller 3*br* rotates by rotation of the feed roller 3*bf*, so that the retard roller 3*br* rotates counterclockwise (forward direction) in FIG. 2. When a plurality of sheets P1 are nipped between the retard roller 3*br* and the feed roller 3*bf*, the retard roller 3*br* rotates clockwise (backward direction) in FIG. 2. The feed roller 3*bf* and the retard roller 3*br* are connected to the feed motor 3*bf*M and the retard motor 3*br*M, respectively, and rotate under the control of the controller 100. Accordingly, even if a plurality of sheets P1 are sent from the sheet-supply roller 3*b*1 toward the feed roller 3*bf*, the feed roller 3*bf* and the retard roller 3*br* cooperate with each other to separate an uppermost one of the plurality of sheets P1 from the rest of the sheets P1, so that the uppermost sheet P1 is sent to the upstream curved path 5.

The rotation speed of the sheet-supply motor 27M driven by the controller 100 is lower than that of the feed motor 3*bf*M, and the rotation torque is large. That is, the sheet supply speed of the sheet P2 by the sheet-supply mechanism 27 is lower than that of the sheet P1 by the sheet-supply mechanism 3*b*, thereby preventing multiple feeding of the sheet P2 when the sheet P2 is supplied by the sheet-supply mechanism 27. Further, the sheet-supply torque of the sheet P2 by the sheet-supply mechanism 27 is higher than that of the sheet P1 by the sheet-supply mechanism 3*b*, thereby enabling the sheet P2 to be supplied by the sheet-supply mechanism 27 with high reliability.

Figure 3:
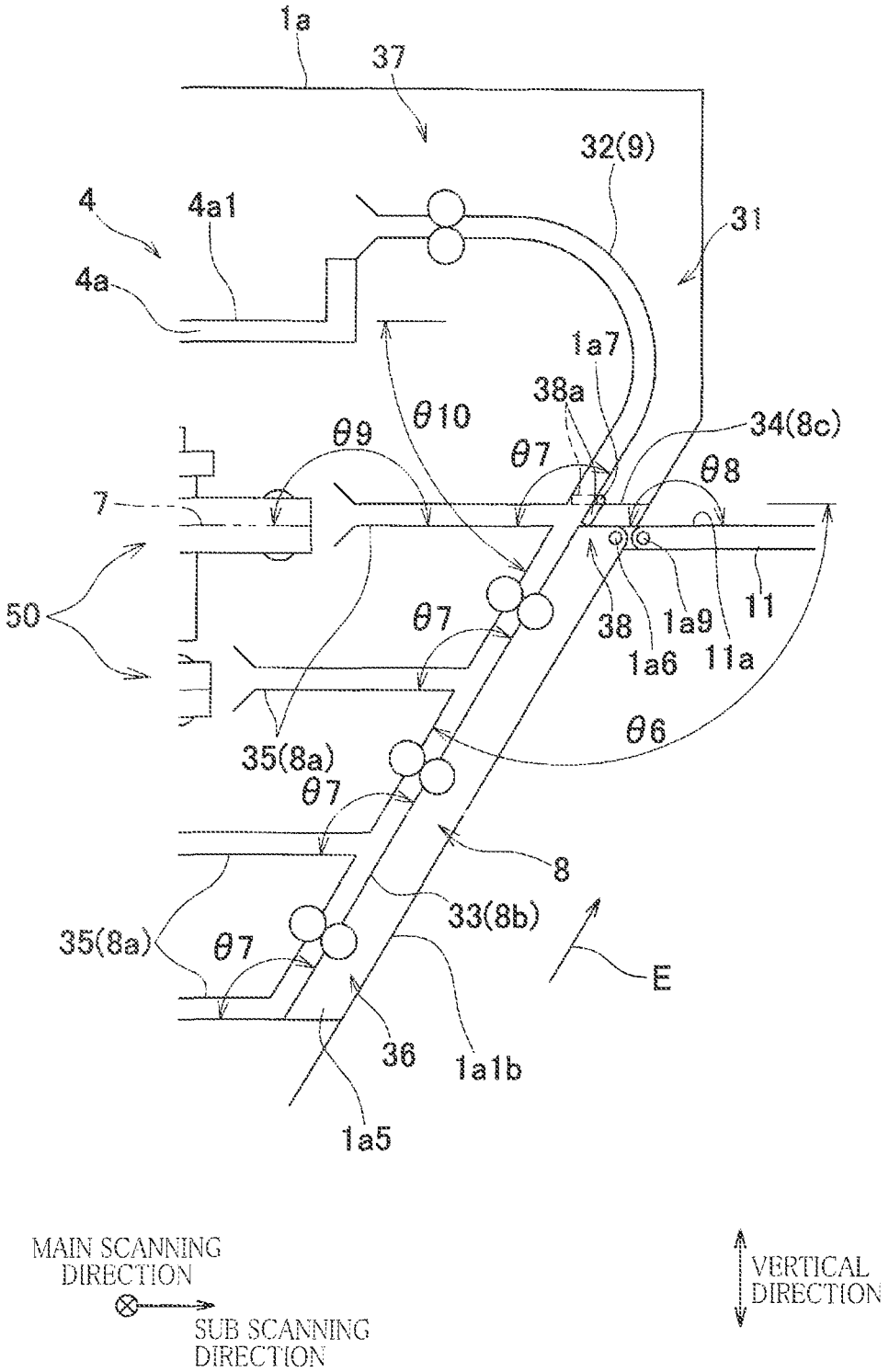
FIG. 3 is a partially enlarged view of the printer shown in FIG. 1.

Referring next to FIG. 3, the downstream guide portion 31 of the conveyor portion 20 will be explained in detail. The guide 32 of the downstream guide portion 31 is formed generally in an arc extending from an upper end of the guide 33 toward the first sheet-discharge portion 4. That is, the downstream curved path 9 is defined by the guide 32 that connects the first sheet-discharge portion 4 and the guide 33.

The downstream conveyance path (as one example of the connection path) 8 is constituted by four downstream first paths 8*a*, a downstream inclined path 8*b*, and a downstream second path 8*c*. Each of the four guides 35 extends in the direction parallel to the sub scanning direction in FIG. 3 and connects the guide 33 and a downstream end of a corresponding one of the intermediate conveyance paths 7. That is, each of the four downstream first paths 8*a* is defined by a corresponding one of the guides 35 that connects the guide 33 and the downstream end of the corresponding one of the intermediate conveyance paths 7, and extends in the sub scanning direction. Like the guides 25, the four guides 35 are disposed so as to be spaced from each other in the vertical direction and are disposed on one of opposite sides of the guide 33 that is remote from the guide 34. The uppermost one of the four guides 35 is connected to an upper end of the guide 33. The lowermost one of the four guides 35 is connected to a lower end of the guide 33.

The guide 33 obliquely extends in an upper right direction in FIG. 3, namely, extends in the direction E (the first direction), so as to define the downstream inclined path 8*b*. In other words, like the upstream inclined path 6*b*, the downstream inclined path 8*b* extends in the direction that intersects the intermediate conveyance path 7 of each recording unit 50. The guide 33 is disposed at a position at which the guide 33 is partially opposed to all of the recording units 50 in the sub scanning direction. The guide 34 extends in the direction parallel to the sub scanning direction in FIG. 4 and is connected to the guide 33. That is, the downstream second path 8*c* is defined by the guide 34 that connects the second sheet-discharge tray 11 and the guide 33, and extends in the sub scanning direction. The guide 34 is disposed on the other of the opposite sides of the guide 33 that is remote from the recording units 50.

The guide 33 is inclined such that an angle θ6 formed by the guide 34 and the guide 33 and an angle θ7 formed by each guide 35 and the guide 33 are the same obtuse angle. In other words, all of the downstream second path 8*c* and the four downstream first paths 8*a* extend in the sub scanning direction, and the downstream inclined path 8*b* is inclined to form the obtuse angle with respect to the downstream second path 8*c* and the four downstream first paths 8*a*. Here, the angle θ7 is an angle formed by: a portion of the guide 33 (the downstream inclined path 8*b*) that is located more downstream than each guide 35; and each guide 35 (the downstream first path 8*a*). The angle θ6 formed by the guide 34 (the downstream second path 8*c*) and the guide 33 (the downstream inclined path 8*b*) is an angle formed by a portion of the guide 33 that is located more upstream than the guide 34; and the guide 34.

The guide 34 (the downstream second path 8*c*) and a support surface 11*a* of the second sheet-discharge tray 11 are linearly connected, and an angle θ8 formed by the guide 34 and the support surface 11*a* is 180°, as shown in FIG. 3. Each of the guides 35 (the downstream first path 8*a*) and a corresponding one of the intermediate conveyance paths 7 are linearly connected. That is, an angle θ9 formed by the downstream first path 8*a* and the intermediate conveyance path 7 is also 180°. While the angles θ8, θ9 are 180° in the present embodiment, each of the angles θ8, θ9 may be an obtuse angle.

In the present embodiment, the angles θ6-θ9 are set so as to be larger than 90° and not larger than 180°. Accordingly, when the sheet P is conveyed from the intermediate conveyance path 7 to the second sheet-discharge tray 11, a maximum bending angle of the sheet P at each of angular portions (i.e., a connecting portion of each intermediate conveyance path 7 and each downstream first path 8*a*, a connecting portion of each downstream first path 8*a* and the downstream inclined path 8*b*, a connecting portion of the downstream inclined path 8*b* and the downstream second path 8*c*, and a connecting portion of the downstream second path 8*c* and the second sheet-discharge tray 11) is less than 90°, as in the instance explained above. Further, even where the sheet P2 is conveyed from the intermediate conveyance path 7 to the second sheet-discharge tray 11, there exist, within the length of the sheet P2, no path in which the sheet P2 is bent in the same direction by 90° or more in total. That is, when the sheet P2 is conveyed from the intermediate conveyance path 7 of the lowermost recording unit 50 to the second sheet-discharge tray 11, one sheet P2 is bent in opposite directions at each connection portion even where some mid portion of the sheet P2 is located at the connecting portion of the downstream first path 8*a* and the downstream inclined path 8*b* at a time point when the leading end of the one sheet P2 passes the connecting portion of the downstream inclined path 8*b* and the downstream second path 8*c*. Therefore, the one sheet P2 is not bent in the same direction by 90° or more.

An angle θ10 formed by the guide 33 and the support surface 4*a*1 of the first sheet-discharge tray 4*a* is an acute angle, as shown in FIG. 3. By thus forming the guide 33 and the first sheet-discharge tray 4*a*, the guide 33 and the first sheet-discharge tray 4*a* can be disposed overlappingly in the vertical-direction view, thereby ensuring size reduction the printer 1. In this respect, the sheet P1 discharged from the downstream inclined path 8*b* to the first sheet-discharge tray 4*a* is bent by 90° or more. However, the sheet P1 accommodated in the first sheet-discharge tray 4*a* is plain paper (such as the sheet P1 that is thinner and easy to be bent as compared with thick paper). Accordingly, even where the sheet P1 is bent by 90° or more, there is no influence on sheet conveyance.

The switching mechanism 38 has the path switching portion 38*a* and the switching motor 38M (FIG. 12) configured to pivot the path switching portion 38*a*. The path switching portion 38*a* is pivotally supported by a pin 1*a*7 provided on the housing 1*a*. The switching motor 38M is driven under the control of the controller 100, whereby the path switching portion 38*a* is placed selectively at one of a first sheet-discharge position and a second sheet-discharge position. At the first sheet-discharge position, the distal end of the path switching portion 38*a* is in contact with the guide 34, as shown in FIG. 3. When the path switching portion 38*a* is located at the first sheet-discharge position, the downstream inclined path 8*b* and the downstream second path 8*c* are prevented from communicating with each other while the downstream inclined path 8*b* and the downstream curved path 9 are brought into communication with each other. Accordingly, when the sheet P1 is supplied from the first sheet-supply tray 3*a*, the switching motor 38M is driven under the control of the controller 100 so as to place the path switching portion 38*a* at the first sheet-discharge position. At the second sheet-discharge position, the distal end of the path switching portion 38*a* is in contact with the guide 32, as shown in the dashed line in FIG. 3. When the path switching portion 38*ab* is located at the second sheet-discharge position, the downstream inclined path 8*b* and the downstream curved path 9 are prevented from communicating with each other while the downstream inclined path 8*b* and the downstream second path 8*c* are brought into communication with each other. Accordingly, when the sheet P2 is supplied from the second sheet-supply tray 10, the switching motor 38M is driven under the control of the controller 100, so as to place the path switching portion 38*a* at the second sheet-discharge position.

As shown in FIGS. 2 and 3, the housing 1*a* has an upstream cover 1*a*1 and a downstream cover 1*a*5. The upstream cover 1*a*1 is provided at an opposing portion of the housing 1*a* that is opposed to the guide 23 in the sub scanning direction (the sheet conveyance direction D). The upstream cover 1*a*1 is supported by a pin 1*a*2 provided on the housing 1*a*, so as to be pivotable relative to the housing 1*a*. The upstream cover 1*a*1 is configured to be placed selectively at one of a closed position shown in FIG. 2 and an open position indicated by the long dashed double-short dashed line in FIG. 1, by a user's operation. To the upstream cover 1*a*1, a portion (the upper portion in FIG. 2) of the guide 24 and a portion (the left-side portion in FIG. 2) of the guide 23 are fixed. At the closed position, the upstream first path 6*a* and the upstream inclined path 6*b* are defined by the guides 23, 24. In this instance, an outer surface 1*a*1*a* of the upstream cover 1*a*1 extends in the same direction as an extension direction E (the above-indicated direction E) of the upstream inclined path 6*b*. Accordingly, it is possible to minimize a distance (space) between the outer surface 1 ala of the housing 1*a* and the upstream inclined path 6*b*, thereby ensuring size reduction of the housing 1*a*. At the open position, the upstream first path 6*a* and the upstream inclined path 6*b* defined by the guides 23, 24 are exposed to the exterior, thereby facilitating removal of the sheet P jammed in the upstream conveyance path 6.

The downstream cover 1*a*5 is provided at an opposing portion of the housing 1*a* that is opposed to the guide 33 in the sub scanning direction (the sheet conveyance direction D). The downstream cover 1*a*5 is supported by a pin 1*a*6 provided on the housing 1*a*, so as to be pivotable relative to the housing 1*a*. The downstream cover 1*a*5 is configured to be placed selectively at one of a closed position shown in FIG. 3 and an open position indicated by the long dashed double-short dashed line in FIG. 1, by a user's operation. To the downstream cover 1*a*5, a portion of the guide 34 (the lower portion in FIG. 3) and a portion of the guide 33 (the right-side portion in FIG. 3) are fixed. At the closed position, the downstream inclined path 8*b* and the downstream second path 8*c* are defined by the guides 33, 34. In this instance, an outer surface 1*a*1*b* of the downstream cover 1*a*5 extends in the same direction as an extension direction E (the above-indicated direction E) of the downstream inclined path 8*b*. Accordingly, it is possible to minimize a distance (space) between the outer surface 1*a*1*b* of the housing 1*a* and the downstream inclined path 8*b*, thereby ensuring size reduction of the housing 1*a*. At the open position, the downstream inclined path 8*b* and the downstream second path 8*c* defined by the guides 33, 34 are exposed to the exterior, thereby facilitating removal of the sheet P1 jammed in the downstream conveyance path 8.

Figure 4:
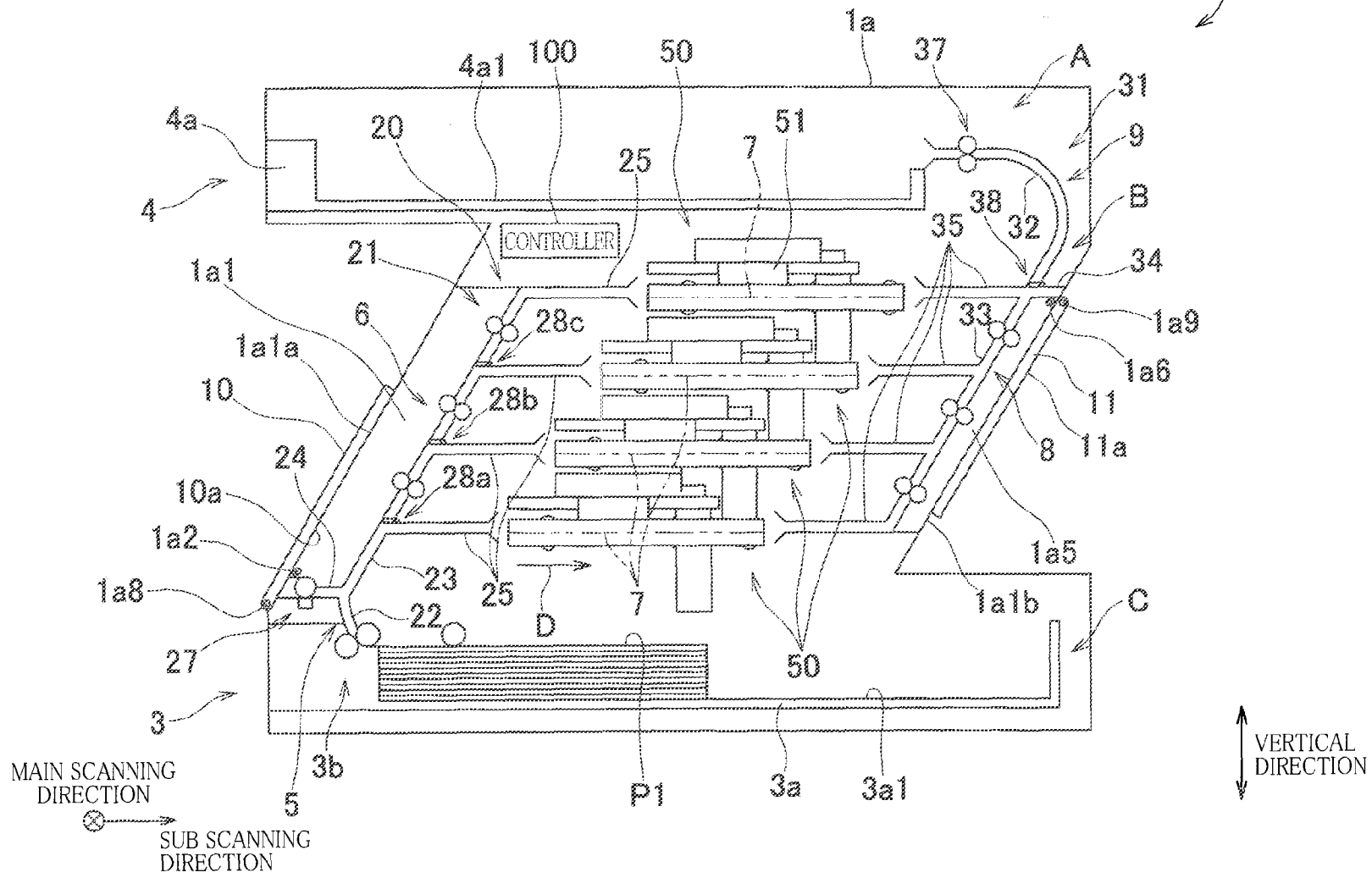
FIG. 4 is a view showing a state in which a second sheet-supply tray and a second sheet-discharge tray of the printer shown in FIG. 1 are disposed at respective accommodated positions.

As shown in FIG. 1, the second sheet-supply tray 10 (as one example of a second common tray) is a plate-like member having the support surface 10*a* for supporting the sheet P2. The second sheet-supply tray 10 is supported by a pin 1*a*8 provided on the housing 1*a*, so as to pivotable relative to the housing 1*a*. The second sheet-supply tray 10 is configured to be placed selectively at one of a sheet-supply position shown in FIG. 1 and an accommodated position shown in FIG. 4, by a user's operation. At the sheet-supply position, the support surface 10*a* is substantially parallel to the sub scanning direction, as shown in FIG. 1, so that the sheet P2 can be placed on the support surface 10*a* of the second sheet-supply tray 10. At the accommodated position, the support surface 10*a* is parallel to the outer surface 1*a*1*a* in a state in which the support surface 10*a* is opposed to the outer surface 1*a*1*a*, namely in a state in which the support surface 10*a* faces inward, as shown in FIG. 4. Thus, the second sheet-supply tray 10 can be folded, thereby ensuring size reduction of the printer 1.

As shown in FIG. 1, the second sheet-discharge tray 11 (as one example of the second common tray) is also a plate-like member having the support surface 11*a* for supporting the sheet P2. The second sheet-discharge tray 11 is supported by a pin 1*a*9 provided on the housing 1*a*, so as to pivotable relative to the housing 1*a*. The second sheet-discharge tray 11 is configured to be placed selectively at one of a sheet-discharge position shown in FIG. 1 and an accommodated position shown in FIG. 4, by a user's operation. At the sheet-discharge position, the support surface 11*a* is substantially parallel to the sub scanning direction, as shown in FIG. 1, so that the discharged sheet P2 can be supported on the support surface 11*a*. At the accommodated position, the support surface 11*a* is parallel to the outer surface 1*a*1*b* in a state in which the second sheet-discharge tray 11 is opposed to the outer surface 1*a*1*b*, as shown in FIG. 4. Thus, the second sheet-discharge tray 11 can be folded, thereby ensuring size reduction of the printer 1.

Figure 5:
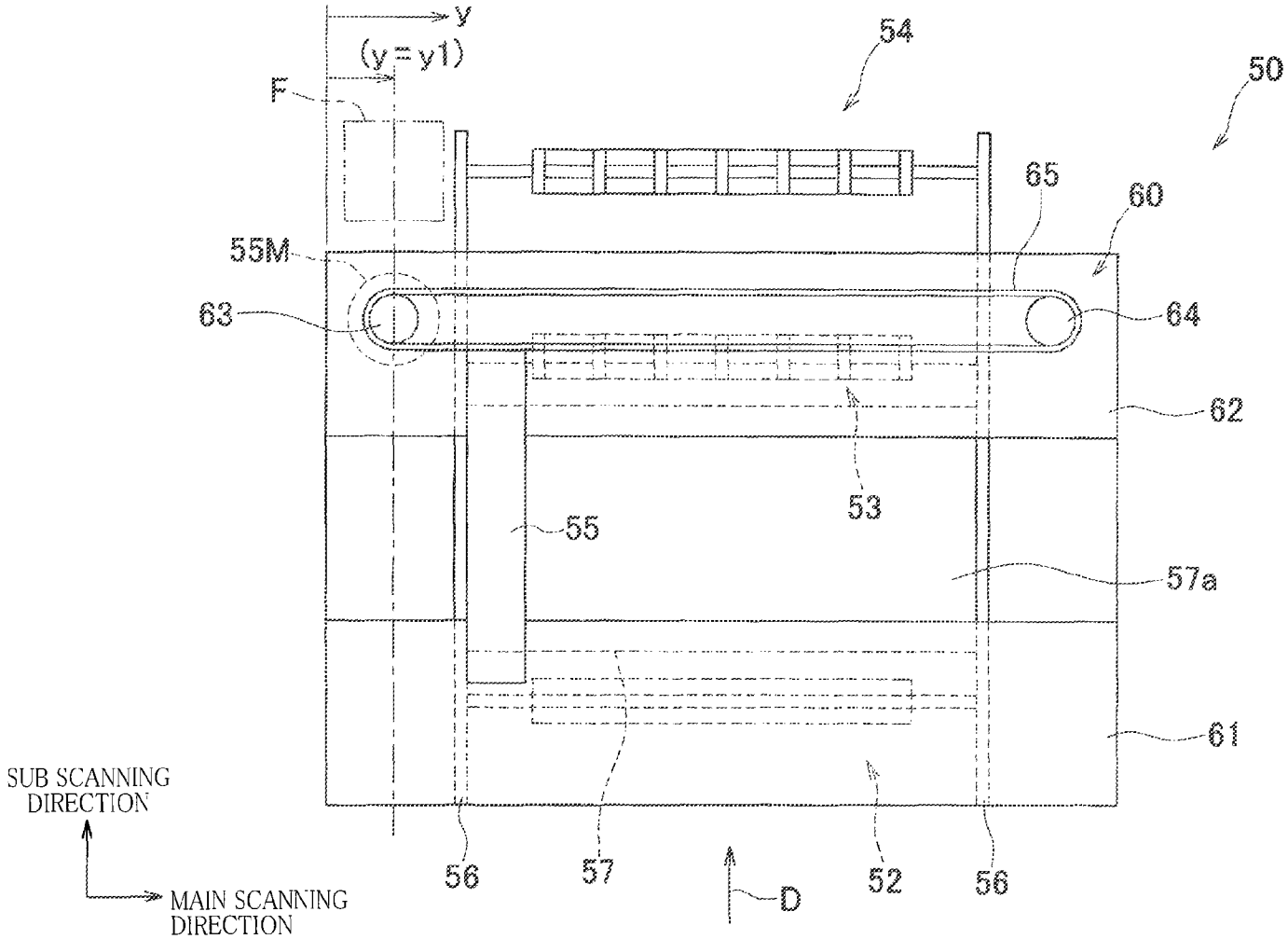
FIG. 5 is a plan view showing a recording unit shown in FIG. 1.
Figure 6:
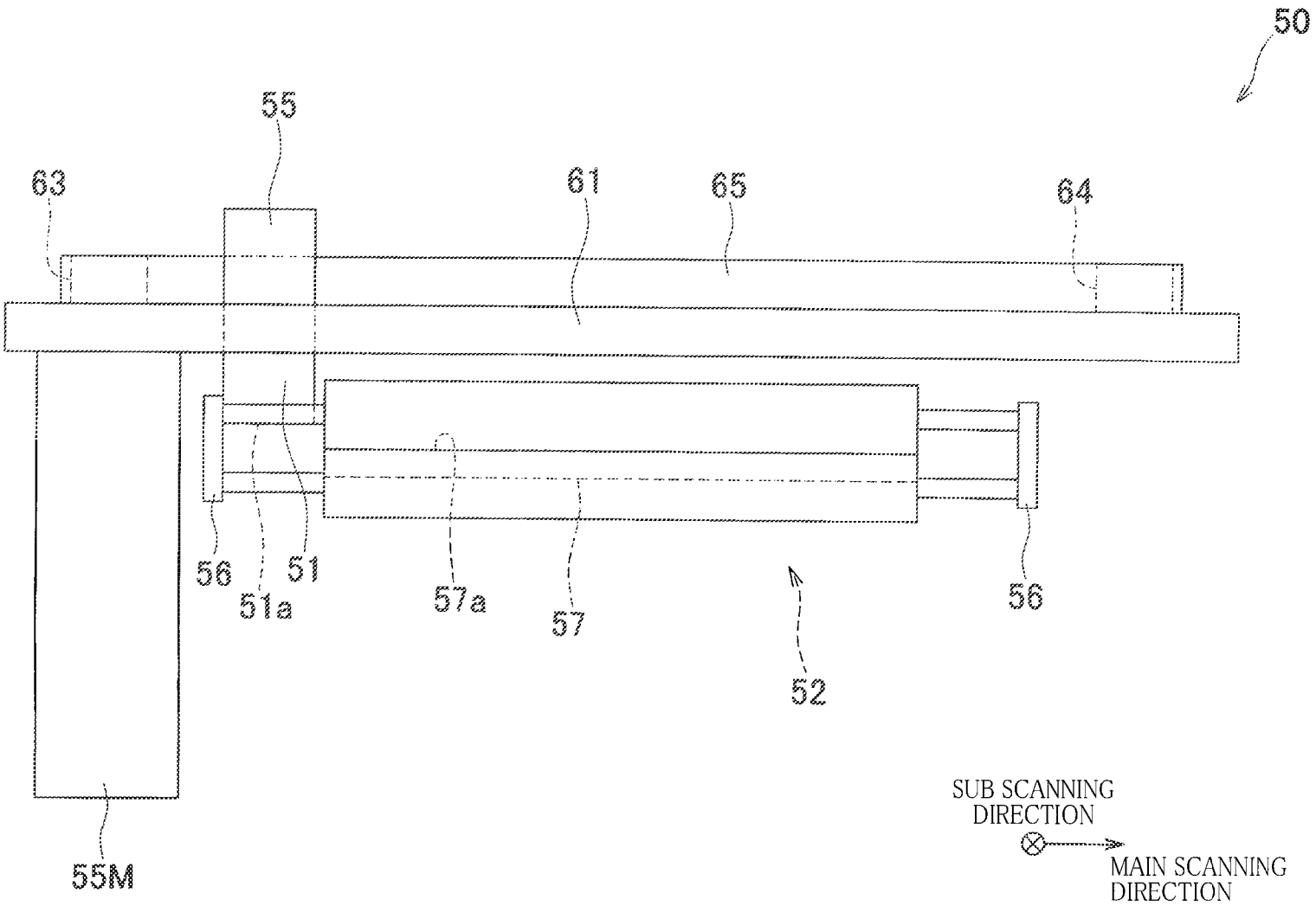
FIG. 6 is a front view of the recording unit shown in FIG. 1.
Figure 7:
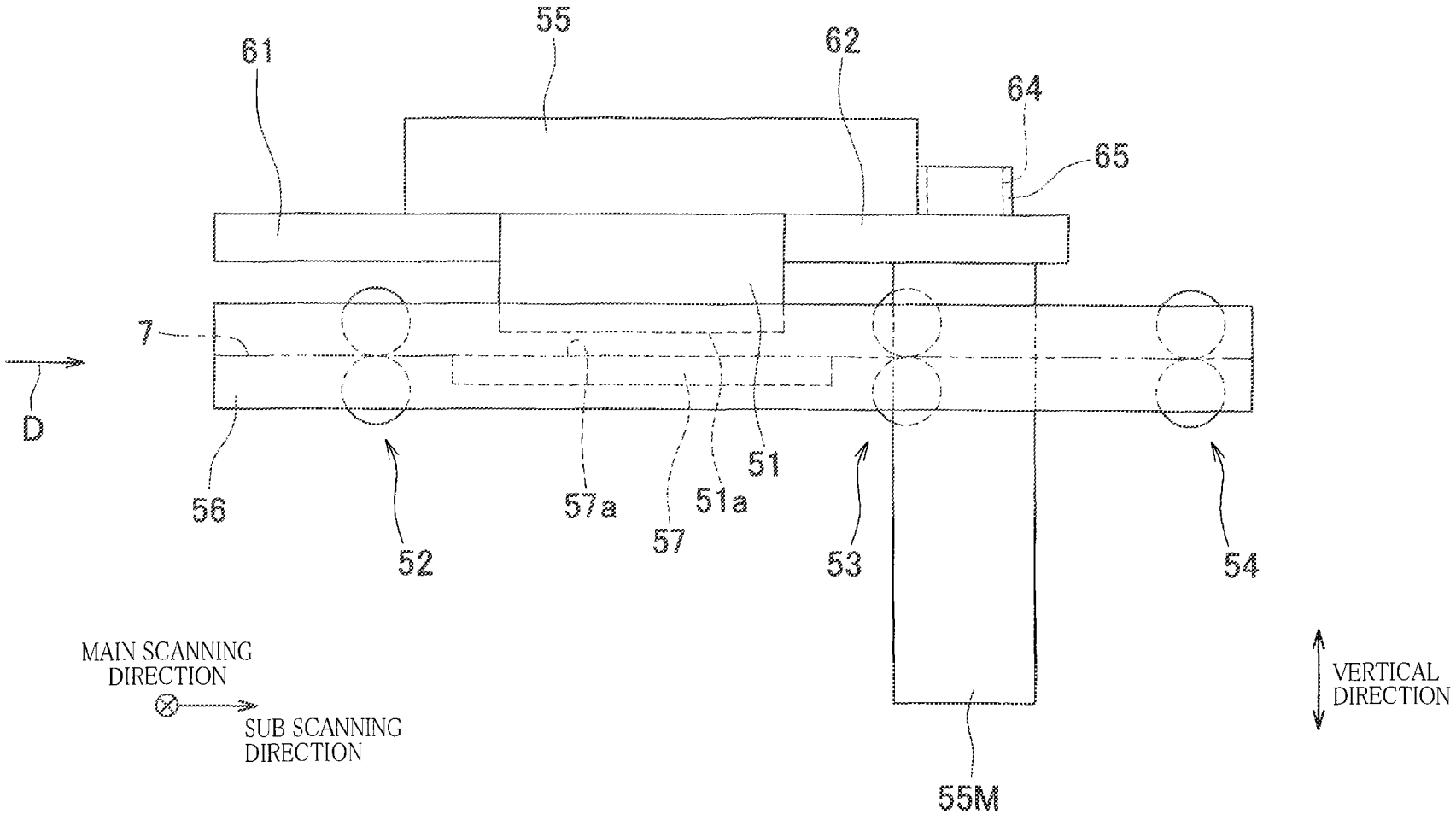
FIG. 7 is a side view of the recording unit shown in FIG. 1.

Referring next to FIGS. 5-7, the four recording units 50 will be explained. Because the four recording units 50 are identical with each other in construction, an explanation is made focusing on one recording unit 50. The recording unit 50 has the head 51, the three conveyance roller pairs 52-54, a platen 57, the carriage 55, a pair of flanges 56, and a moving mechanism 60. The head 51 has a generally rectangular parallelepiped shape and its upper surface is supported by the carriage 55. The head 51 has a lower surface functioning as an ejection surface 51*a* in which a multiplicity of ejection openings are open. When a recording operation is performed, black ink is ejected from the ejection surface 51*a*. The head 51 is supported by the housing 1*a* via the carriage 55 and the moving mechanism 60. A predetermined spacing suitable for recording is formed between the ejection surface 51*a* and the platen 57.

As shown in FIGS. 5 and 7, the flanges 56 extend in parallel with each other and are spaced apart from each other with a predetermined spacing therebetween. The flanges 56 support the platen 57. Further, the flanges 56 rotatably support the conveyance roller pairs 52-54. The platen 57 is disposed at a position at which the platen 57 is opposed to the ejection surface 51*a* of the head 51. The platen 57 has a flat conveyor surface 57*a*. The platen 57 is configured to support the sheet P from below and cooperates with the ejection surface 51*a* to define therebetween a recording region (a part of the intermediate conveyance path 7). The three conveyance roller pairs 52-54 are disposed in parallel with one another and configured to convey the sheet P in a direction orthogonal to the roller pairs. The direction in which the sheet P is conveyed is the sheet conveyance direction D (the sub scanning direction). The conveyance roller pair 52 is disposed upstream of the platen 57. The conveyance roller pairs 53, 54 are disposed downstream of the platen 57. An upper one of the rollers of each conveyance roller pair 53, 54 is a spur roller having a plurality of spurs, as shown in FIG. 5. In the arrangement, an image formed on the sheet P is not likely disturbed by the conveyance roller pairs 53, 54. The conveyance motors 52M-54M (FIG. 12) are driven under the control of the controller 100, whereby the three conveyance roller pairs 52-54 rotate so as to convey the sheet P along the sheet conveyance direction D. The intermediate conveyance path 7 is defined by a gap between the rollers of each conveyance roller pair 52-54 and the spacing between the ejection surface 51*a* of the head 51 and the platen 57. In the present embodiment, the intermediate conveyance path 7 extends in parallel to the sub scanning direction. It is noted that the intermediate conveyance path 7 may be partially curved. That is, the intermediate conveyance paths 7 of the respective four recording units 50 may be at least partially parallel to one another, namely, the intermediate conveyance paths 7 may be disposed such that at least recording regions of the respective four recording units 50 are parallel to one another.

The moving mechanism 60 includes a pair of guides 61, 62, two pulleys 63, 64, a belt 65, and the carriage motor 55M. As shown in FIGS. 5 and 7, the guides 61, 62 have a rectangular shape in plan view and are disposed so as to be spaced apart from each other in the sub scanning direction with the upper portion of the head 51 sandwiched therebetween. The guides 61, 62 support opposite ends of the carriage 55 in the sub scanning direction such that the carriage 55 is slidable in the main scanning direction. The two pulleys 63, 64 are rotatably supported by opposite ends of the guide 62 in the main scanning direction. The pulleys 63, 64 have the same diameter and are disposed at the same position with respect to the sub scanning direction. The belt 65 is an endless belt looped over the two pulleys 63, 64 and is configured to move by rotation of the pulley 63. A part of the belt 65 is attached to the carriage 55. The carriage motor 55M is fixed to a lower surface of the guide 62. The carriage motor 55M has a cylindrical shape that is long in the vertical direction. The pulley 63 is attached to a rotation shaft of the carriage motor 55M.

In the structure described above, the carriage motor 55M is driven under the control of the controller 100 such that the pulley 63 is rotated in forward and reverse directions, whereby the head 51 is reciprocatingly moved in the main scanning direction, together with the carriage 55. In the reciprocating movement of the head 51, the controller 100 controls the head 51 to eject ink from the ejection surface 51*a* at desired timing, so that an image is recorded on the conveyed sheet P. The head 51, the carriage 55, and the moving mechanism 60 constitute one example of a recording portion configured to record an image on the sheet P. The pulley 64 is a driven pulley configured to rotate by the movement of the belt 65.

The four recording units 50 have substantially the same external shape. As described below, in some cases, there are attached, to some of the recording portions, components that other recording portions do not have or components different in shape from components in other recording portions. However, in the present invention, even if the recording portions have different external shapes, common portions in the recording portions and a portion that is enclosed by the common portions and that does not influence the external shape are referred to as a recording module according to the present invention. Each recording unit having a different external shape is treated as the recoding unit 50 constituted by the recording module and another component attached thereto. Accordingly, the recording modules may be regarded to have the same external shape. The recording module in the present invention preferably has at least components that contribute to image recording, such as the head 51 and the carriage motor 55M for the carriage 55. Where the four recording units 50 are identical in structure and external shape, it is possible to regard that one recording module and one recording unit 50 are equivalent to each other. Where one recording module and one recording unit 50 are equivalent to each other and the printer has a function of performing image recording only by the recording modules, it is possible to realize the present invention by applying, to the present printer, a plurality of recording modules used in other printers, thereby reducing the cost of the recording modules.

The recording units 50 are identical in shape and have respective portions having mutually the same shape (each of which is hereinafter referred to as "same-shaped portion" where appropriate). In the present invention, an arrangement direction (the first direction) is defined as a direction along a straight line that connects the same-shaped portions of any adjacent two recording units 50. In other words, at a position to which one recording unit 50 is three-dimensionally translated in the direction E, another recording unit 50 adjacent to the one recording unit 50 is located. There are three pairs of adjacent two recording units 50 in the four recording units 50, and the arrangement direction can be defined for each of the three pairs. The arrangement direction may differ in each of the three pairs. In the present embodiment, however, the arrangement direction in each three pair is identical to the above-indicated direction E, in other words, the same-shaped portions of the four recording units 50 align with one another along the straight line, for the sake of convenience.

Figure 8:
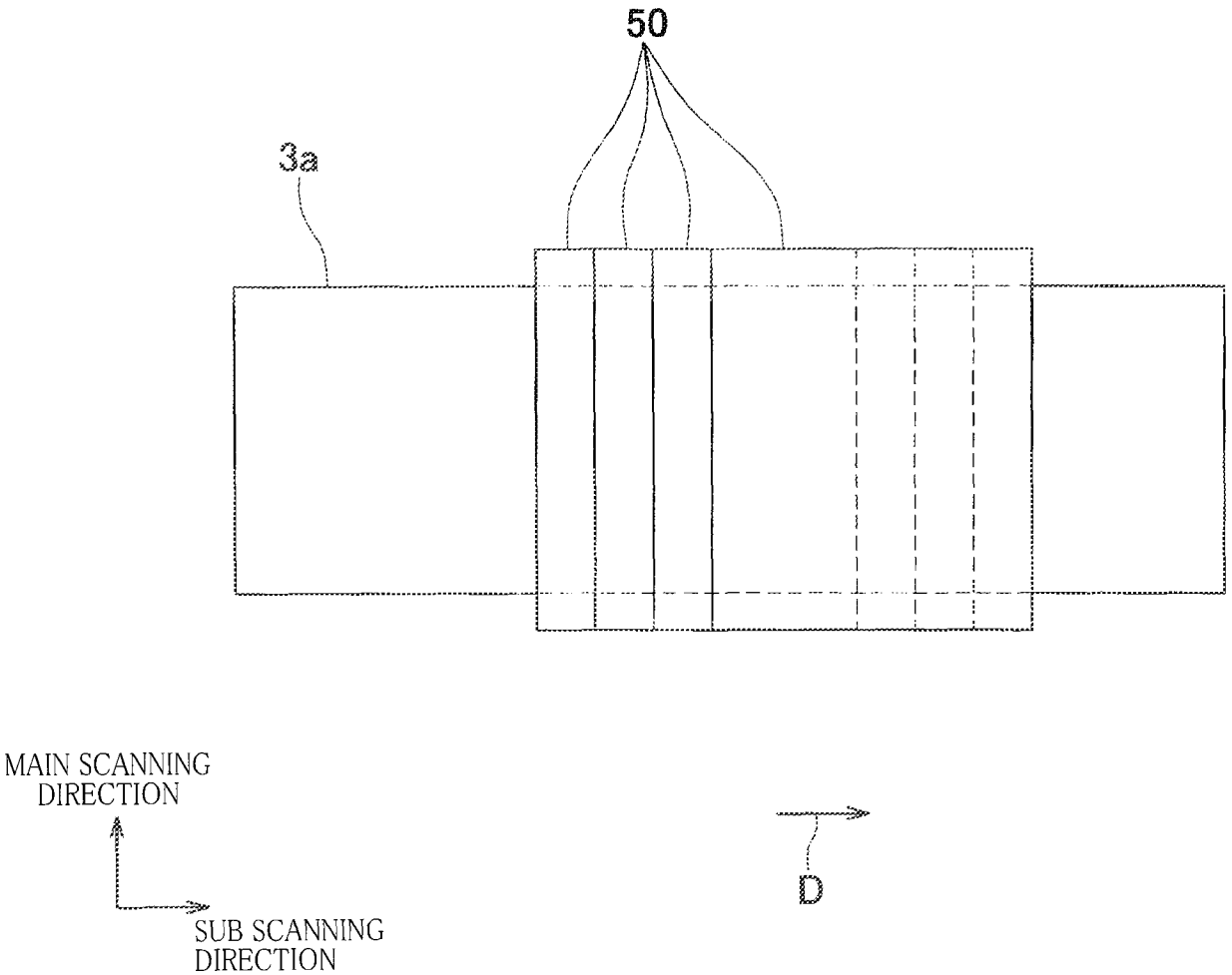
FIG. 8 is a plan view showing a positional relationship between four recording units and a first sheet-supply tray.

The arrangement direction of each of the four recording units 50 is identical to the extension direction E of the upstream and downstream inclined paths 6*b*, 8*b*, as shown in FIG. 1. That is, the four recording units 50 are disposed such that shift amounts of the respective four recording units 50 in the sheet conveyance direction D from a connection point of the first sheet-supply tray 3*a* and the upstream conveyance path 6 increase with an increase in a distance between each recording unit 50 and the first sheet-supply tray 3*a* in a direction away from the first sheet-supply tray 3*a* toward above. More specifically, the shift amount of one recording unit 50 from the connection point in the sheet conveyance direction D is larger than that of another recording unit 50 that is located nearer to the first sheet-supply tray 3*a* than the one recording unit 50. In other words, the four recording units 50 are disposed such that the shift amounts of the respective four recording units 50 in a direction parallel to the sheet conveyance direction D from a connection point of the first sheet-discharge tray 4*a* and the downstream conveyance path 8 increase with an increase in a distance between each recording unit 50 and the first sheet-discharge tray 4*a* in a direction away from the first sheet-discharge tray 4*a* toward below. According to the arrangement, by shifting the recording units 50 in the sheet conveyance direction D, at least a part of an increase in the overall size of the plurality of recording units 50 in the sheet conveyance direction D is contained within a range in which the first sheet-supply tray 3*a* or the first sheet-discharge tray 4*a* is present. Therefore, even where the entirety of the plurality of recording units 50 becomes large, the size, in the sheet conveyance direction D, of the printer 1 as a whole including the first sheet-supply tray 3*a* or the first sheet-discharge tray 4*a* does not become large and the size of the printer 1 in the vertical direction is reduced. As a result, the printer 1 can be downsized. Further, the four recording units 50 are located at the same position with respect to the main scanning direction, as shown in FIG. 8. In other words, a component of the direction E in a direction parallel to the conveyor surface 57*a* (referred to as "direction x") is the same as the sheet conveyance direction D. The direction x is a direction of orthogonal projection of the direction E onto the conveyor surface, and it may be considered that the direction x coincides with the sheet conveyance direction D in the present embodiment. Because the four recording units 50 are regularly arranged, a layout of two recording units 50 adjacent to each other in the direction E will be explained with reference to FIGS. 9-11.

Figure 9:
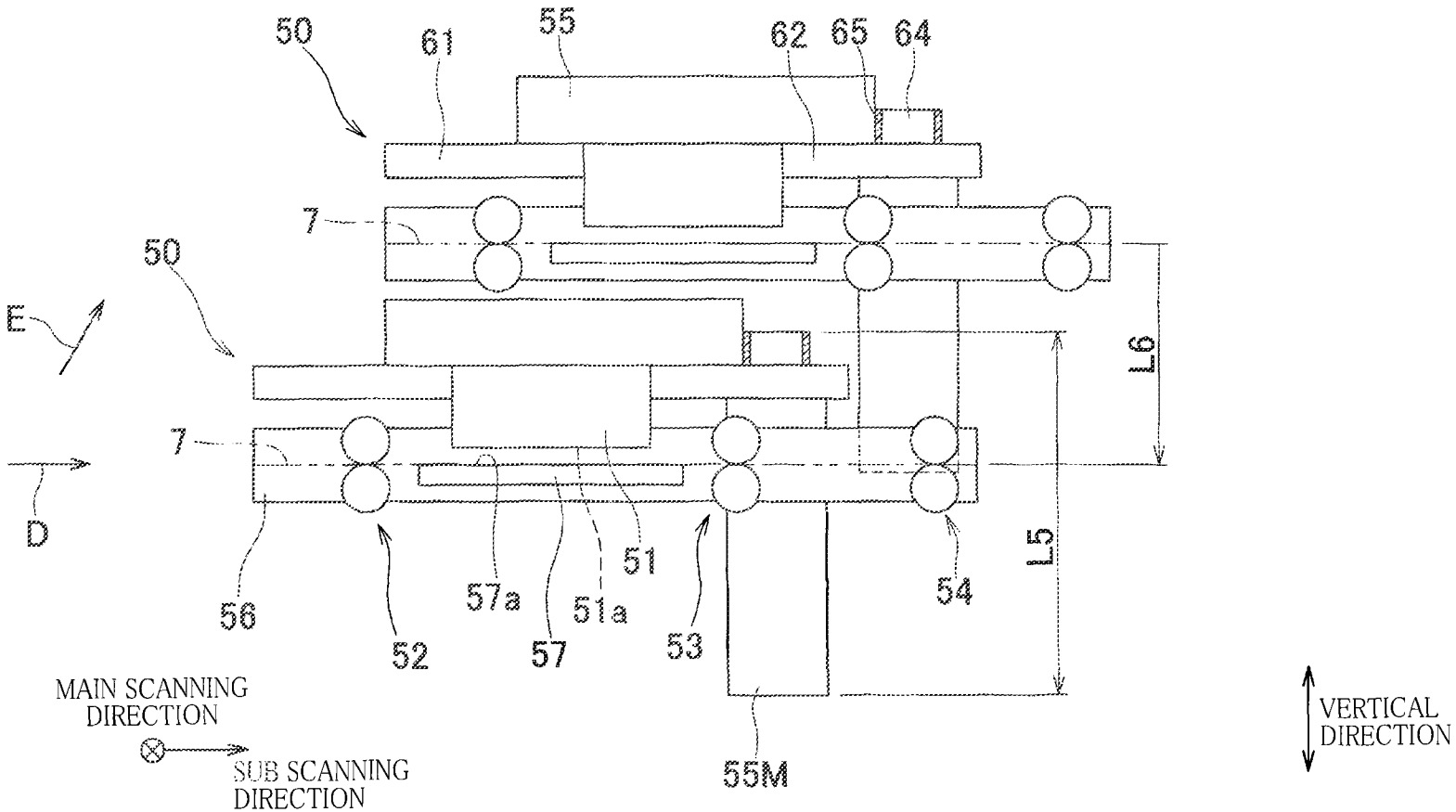
FIG. 9 is a side view of two adjacent recording units for explaining a layout thereof.

As shown in FIG. 9, an upper one of the two recording units 50 and a lower one of the two recording units 50 are disposed such that the conveyor surfaces 57*a* of the respective platens 57 are parallel to each other. In other words, the two recording units 50 are disposed such that the intermediate conveyance paths 7 (indicated by the long dashed double-short dashed line in FIG. 9) in the respective two recording units 50 are parallel to each other. Here, each intermediate conveyance path 7 is a path which is located on one plane that is parallel to and the same as the conveyor surface 57*a* and which is indicated by an imaginary plane for supporting the sheet P.

Figure 10:
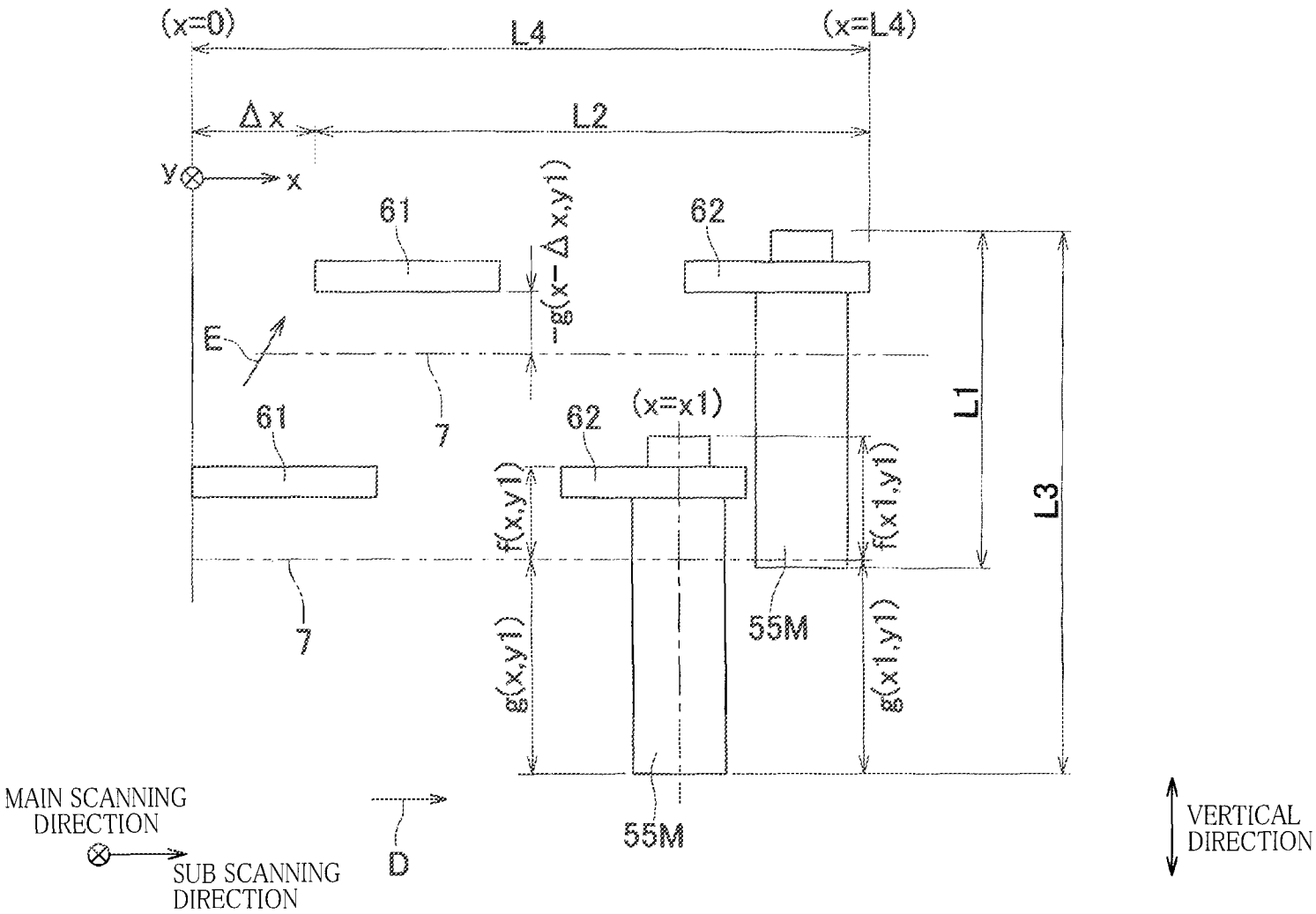
FIG. 10 is a cross-sectional view of two adjacent recording units showing an external shape thereof at a position y=y1 in FIG. 5 for explaining a layout of the two adjacent recording units.

FIG. 10 is a certain cross-sectional view of the recording units 50 in a plane which passes the center of each carriage motor 55M and which is orthogonal to the conveyor surfaces 57*a* and is parallel to the direction E. More specifically, FIG. 10 is a cross-sectional view at a position y=y1 in FIG. 5. The two recording units 50 are disposed such that a dimension (size) L3 of the two recording units 50 in the vertical direction is smaller than a sum of dimensions (size) L1 of the respective two recording units 50 in the vertical direction and such that a dimension (size) L4 of the two recording units 50 in the direction x orthogonal to the vertical direction is smaller than a sum of dimensions (sizes) L2 of the respective two recording units 50 in the direction x. Further, the two recording units 50 are disposed such that the dimension L4 is larger than the dimension L2. In this respect, while an infinite number of such cross sections are present in the main scanning direction and the dimensions L1-L4 described above are defined for individual cross sections, it is only required that at least one cross section in which the relation described above is established be present among the cross sections. Where each recording module has at least one such cross section described above, the overall size of the plurality of recording units 50 in the vertical direction becomes smaller when arranged as described above. Because the direction E is orthogonal to the main scanning direction in the present embodiment, the direction x that is a direction of projection of the direction E onto the conveyor surface coincides with the sheet conveyance direction D. This direction x is a third direction in the present invention.

In the present embodiment, the upper recording unit 50 is shifted from the lower recording unit 50 in the direction x, namely, in the sheet conveyance direction D, by a predetermined amount Δx and is disposed adjacent to the lower recording unit 50 in the vertical direction. More specifically, the carriage motor 55M of the upper recording unit 50 is disposed at a position that overlaps an imaginary region F shown in FIG. 5 in the vertical-direction view. This imaginary region F is located in space in which no constituent elements of the lower recording unit 50 are provided. The imaginary region F overlaps the conveyance roller pair 54 of the lower recording unit 50 as viewed in the main scanning direction and overlaps the carriage motor 55M of the lower recording unit 50 as viewed in the sub scanning direction. By overlapping the imaginary region F of the recording unit 50 and the carriage motor 55M of the upper recording unit 50 in the vertical-direction view, the two recording units 50 can be disposed close to each other in the vertical direction. Accordingly, as shown in FIG. 10, in the cross-section that passes the carriage motors 55M, there are satisfied the conditions that the dimension L3 is smaller than twice the dimension L1, the dimension L4 is smaller than twice the dimension L2, and the dimension L4 is larger than the dimension L2.

Each recording unit 50 has the longest portion (the largest portion) that has the longest (the largest) dimension therein in the vertical direction. The longest portion (as one example of a first portion) is constituted by the carriage motor 55M, the guide 62, and the pulley 63 in the present embodiment. As shown in FIG. 9, the two recording units 50 are disposed such that a dimension (distance) L6 between the conveyor surfaces 57*a* of the respective two recording units 50 in the vertical direction is smaller than a dimension (size) L5 of the longest portion of one recording unit 50 in the vertical direction.

Accordingly, even if each recording unit 50 has the longest portion, it is possible to easily reduce the size of the printer 1 in the vertical direction.

There will be explained in more detail such a layout and conditions satisfied by a shape of the recording module that enables such a layout. As shown in FIG. 10, in a three-dimensional coordinate system, an axis extending in the direction x is defined as an x-axis, an axis extending in a direction orthogonal to the x-axis in the conveyor surface 57*a* is defined as a y-axis, the left end of the recording unit 50 is defined as x=0, and the right end of the recording unit 50 is defined as x=L4. Here, the direction x is a direction of projection of the direction E (that is the arrangement direction of the recording units) onto the intermediate conveyance path 7 of the lower recording unit 50, namely, onto the imaginary plane that is located on one plane parallel to and the same as the conveyor surface 57*a*. Where the thickness of an upper portion located higher than the intermediate conveyance path 7 is defined as f(x, y) and the thickness of a lower portion located lower than the intermediate conveyance path 7 is defined as g(x, y), the thickness f and the thickness g can be expressed as a function of the position x and the position y. FIG. 10 shows a cross section when y=y1. Where f<0 is established when the upper surface of the recording unit 50 is located at a height level lower than the intermediate conveyance path 7, g<0 is established when the lower surface of the recording unit 50 is located at a height level higher than the intermediate conveyance path 7, and f=g=0 is established at a position where the recording unit 50 is not present, it is possible to define the values f, g over the entire region of x, y. The upper recording unit 50 in this instance is shifted in the direction x by the predetermined amount Δx. Accordingly, in the upper recording unit 50, the thickness of the upper portion located higher than the intermediate conveyance path 7 is expressed as f(x−Δx, y1) while the thickness of the lower portion located lower than the intermediate conveyance path 7 is expressed as g(x−Δx, y1). Further, at a position at which the thickness of the recording unit 50 is maximum, x=x1 is established. This position corresponds to the first portion in the present embodiment.

Figure 11:
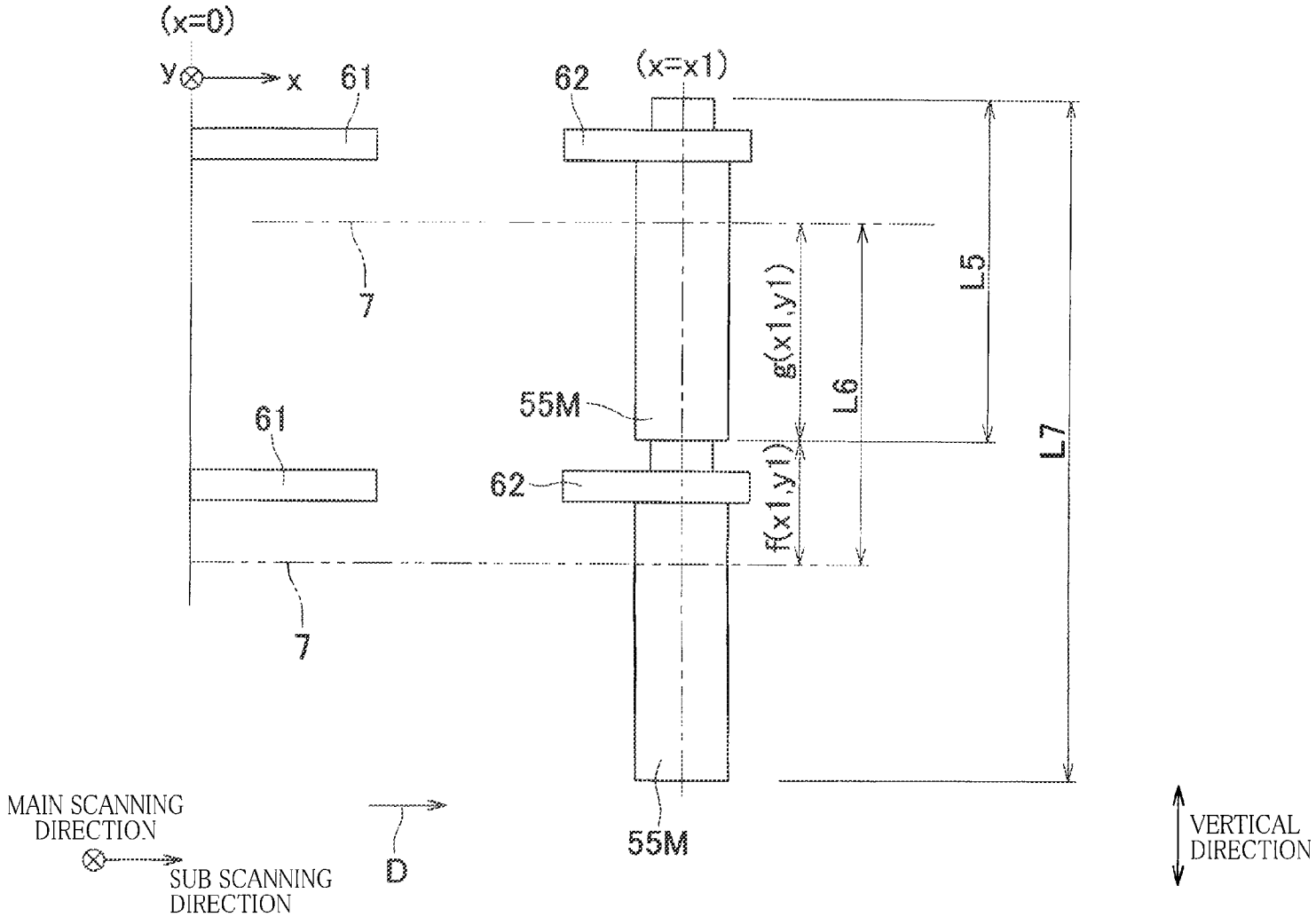
FIG. 11 is a cross-sectional view of the two recording units of FIG. 10 showing an external shape thereof at a position $\Delta x=0$ for explaining a layout of the two recording units.

FIG. 11 shows a cross section at a position y−y1 when Δx=0. In this instance, adjacent recording units 50 contact each other at a position x=x1. Therefore, it is impossible to bring the recording units 50 close to each other beyond a maximum dimension (thickness), at this position, L5=f(x1, y1)+g(x1, y1). In other words, the distance L6 between the conveyor surfaces 57*a* of the respective adjacent two recording units 50 is limited to L6≥L5 when Δx=0.

Here, where the upper recording unit 50 is shifted in the direction of the x-axis (hereinafter referred to as "x-axis direction" where appropriate) in a range of 0<Δx<L4, the distance L6 between the conveyor surfaces 57*a* of the respective adjacent two recording units 50 is limited to a value not smaller than a minimum value of f(x, y1)+g(x−Δx, y1). Where the recording unit 50 has a shape in which there exists, in the entire region of x, Δx that satisfies f(x, y1)+g(x−Δx, y1)<L5, the two recording units 50 can be disposed so as to satisfy L6<L5, by shifting the upper recording unit 50 by Δx in the x-axis direction, i.e., in the conveyance direction in the present embodiment. Such Δx is not necessarily present in the recording module in any shape. However, when the recording module has a shape in which f(x, y) or g(x, y) is not constant, such Δx is present in most cases. Further, the shape of the recording module in which such Δx is present is considered in numerous numbers other than the shape shown in FIG. 10.

As shown in FIG. 11, there is defined, as a dimension (size) L7, an entire dimension of the two recording units 50 in the vertical direction in a cross section at a position y=y1 when the upper recording unit 50 is disposed at the same position as the lower recording unit 50 on the imaginary plane parallel to the conveyor surface 57*a* and the two recording units 50 are disposed at a position at which the two recording units 50 are in contact with each other in the vertical direction, namely, at a position at which the lower end (the carriage motor 55M) of the upper recording unit 50 is in contact with the upper end of the lower recording unit 50. (At this position, y=y1 is established, and FIG. 11 is a view in a cross section at a position y=y1.). In this case, the dimension L3 (FIG. 10) of the two recording units 50 in the present embodiment is smaller than the dimension L7. That is, the following relationship is established: L3=L6+(a maximum value of f(x, y1))+(a maximum value of g(x, y1))=L6+L1, and L7=(a maximum value of f(x, y1))+L5+(a maximum value of g(x, y1))=L5+L1. Therefore, it is to be understood that L3<L7 is established when L6<L5 is established. In other words, to bring the distance between the conveyor surfaces 57*a* close to a value not larger than the thickness of the maximum thickness portion of the recording unit 50 by shifting the recording unit 50 in the direction parallel to the conveyor surface 57*a* is synonymous with to decrease the entire thickness of the two recording units 50 by shifting the recording unit 50 in the direction parallel to the conveyor surface 57*a*, as compared with a case in which the recording unit 50 is not shifted. In this respect, the dimension L7 is also defined for individual cross sections. Where each recording unit 50 has at least one cross section that satisfies the above relationship among the cross sections, the entire dimension of the plurality of recording units 50 in the vertical direction is made small when the recording units 50 are disposed as described above. Each of the dimensions L6, L5 is defined in any cross section.

As described above, in the printer 1 of the present embodiment, any two recording units 50 that are adjacent to each other in the direction E are disposed such that the dimension L3 is smaller than twice the dimension L1, the dimension L4 is smaller than twice the dimension L2, and the dimension L4 is larger than the dimension L2. According to the arrangement, the plurality of recording units 50 are disposed so as to be shifted relative to each other in the sheet conveyance direction D. Therefore, the recording units 50 can be disposed so as to be close to each other in the vertical direction, thereby ensuring size reduction of the printer 1 in the vertical direction.

The dimension L3 of the entirety of the two recording units 50 is smaller than the dimension L7, whereby it is possible to easily reduce the size of the printer 1 in the vertical direction, as compared with a case in which the plurality of recordings units 50 are arranged in the vertical direction.

The four recording units 50*b* are disposed at the same position with respect to the main scanning direction. Accordingly, it is possible to reduce a margin (positional margin) that is allowed for the width of the recording unit 50 in the main scanning direction with respect to the width of the sheet P1 in the main scanning direction, as compared with a case in which the recording units 50 are shifted relative to each other in the main scanning direction. Therefore, the size of the printer 1 can be minimized. Further, because the four recording units 50*b* are disposed at the same position with respect to the main scanning direction, the sheet P can be easily conveyed to each recording unit 50.

The upstream conveyance path 6 includes the upstream inclined path 6*b*, and the downstream conveyance path 8 includes the downstream inclined path 8*b*. Accordingly, a direction along the straight line that connects the same-shaped portions of the respective recording units 50 (i.e., a straight line parallel to the direction E) is a direction in which a length of a conveyance path (the upstream conveyance path 6 or the downstream conveyance path 8) that connects the recording units 50 is the shortest. Therefore, the length of the upstream conveyance path 6 is made shorter where a part of the upstream conveyance path 6 is constituted by the upstream inclined path 6*b* and the length of the downstream conveyance path 8 is made shorter where a part of the downstream conveyance path 8 is constituted by the downstream inclined path 8*b*, as compared with a case in which each of the upstream and downstream conveyance paths 6, 8 is constituted by a combination of only vertical and horizontal paths. Further, where the upstream and downstream conveyance paths 6, 8 are thus constituted, a vicinity of a connecting portion of the upstream conveyance path 6 and each recording unit 50 and a vicinity of a connecting portion of the downstream conveyance path 8 and each recording unit 50 are common in shape among the recording units 50. Accordingly, it is possible to easily ensure commonality of constituent components in the upstream conveyance path 6, commonality of constituent components in the downstream conveyance path 8, and commonality of a drive control for sheet conveyance when the sheet P enters and goes out of each recording unit 50.

The present printer 1 has the first sheet-supply tray 3*a* as a common sheet-supply tray that is common to the recording units 50 and that is connected to the upstream conveyance path 6. Accordingly, it is not necessary to set the sheets P individually into the four recording units 50, and a multi-engine high-speed printer having a reduced size is realized. Further, the first sheet-supply tray 3*a* is capable of supporting a larger amount of sheets than the second sheet-supply tray 10. The user's convenience is enhanced by accommodating a large amount of plain paper that may be bent (ordinary recording media) in the first sheet-supply tray 3*a*. Further, the printer 1 has the first sheet-discharge tray 4*a* as a common sheet-discharge tray that is common to the recording units 50 and that is connected to the downstream conveyance path 8. Accordingly, it is not necessary to put together the sheets P1 that have been discharged individually from the four recording units 50, and a multi-engine high-speed printer having a reduced size is realized.

For instance, in the conventional printer described above, it may be possible to provide sheet-supply units and discharged-sheet collection units individually for respective printing units and to form an upstream conveyance path and a downstream conveyance path corresponding to each printing unit such that a recording sheet is not bent by 90° or more in each path. In this instance, however, it is required for the user to set recording sheets individually into the respective sheet-supply units and to take out the printed sheets individually from the respective discharged-sheet collection units, imposing inconvenience on the user. In contrast, in the present printer 1 in which the four recording units 50 are arranged in the direction E and which has the second sheet-supply tray 10 or the second sheet-discharge tray 11 (each as one example of the second common tray) common to the four recording units 50, the bending angle of the sheet P2 does not become 90° or more even when the sheet P2 is conveyed into between the second sheet-supply tray 10 or the second sheet-discharge tray 11 and each recording unit 50. Therefore, a conveyance resistance of the sheet P2 between the second sheet-supply tray 10 or the second sheet-discharge tray 11 and each recording unit 50 is made small, whereby it is possible to suppress an occurrence of a jam of the sheet P2, a stain and a damage of the sheet P2 caused by a sliding contact with components other than the guides that define the upstream conveyance path 6 or the downstream conveyance path 8, and an occurrence of image quality deterioration that arises from floating of the sheet P2 in the recording region.

The present printer 1 has the second sheet-supply tray 10 common to the four recording units 50 and the upstream conveyance path 6 that connects the second sheet-supply tray 10 and each recording units 50, thereby making it possible to suppress an occurrence of a jam of the sheet P2 that is conveyed from the second sheet-supply tray 10 to each recording unit 50. Further, the present printer 1 has the second sheet-discharge tray 11 common to the four recording units 50 and the downstream conveyance path 8 that connects each recording unit 50 and the second sheet-discharge tray 11, thereby making it possible to suppress an occurrence of a jam of the sheet P2 that is conveyed from each recording unit 50 to the second sheet-discharge tray 11.

Figure 13:
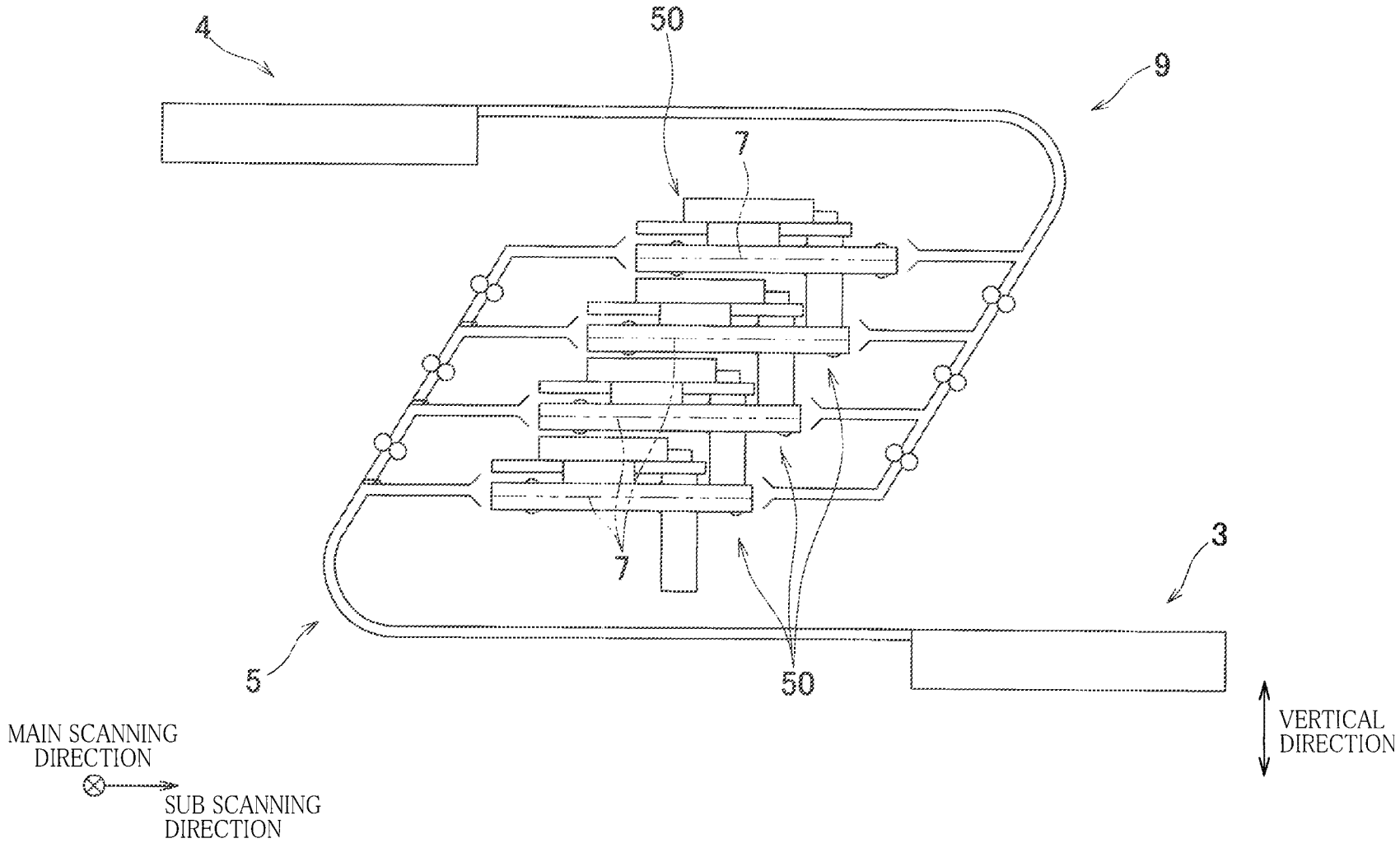
FIG. 13 is a schematic view of a printer according to a first modified embodiment.

Referring next to FIG. 13, there will be explained a first modified embodiment. As shown in FIG. 13, the first sheet-supply portion 3 may be disposed rightward of all of the recording units 50, and the first sheet-discharge portion 4 may be disposed leftward of all of the recording units 50. That is, the first sheet-supply portion 3 and the first sheet-discharge portion 4 may be disposed so as not to overlap any of the recording units 50 in the vertical-direction view. This arrangement ensures size reduction of the printer in the vertical direction, as in the illustrated embodiment. In this first modified embodiment, a portion of each of the upstream curved path 5 and the downstream curved path 9 that extends in the sub scanning direction is longer, as compared with that in the illustrated embodiment. Further, as a modified example, the printer 1 may be configured not to have the second sheet-supply tray 10 and the second sheet-discharge tray 11, as shown in FIG. 13.

Figure 14:
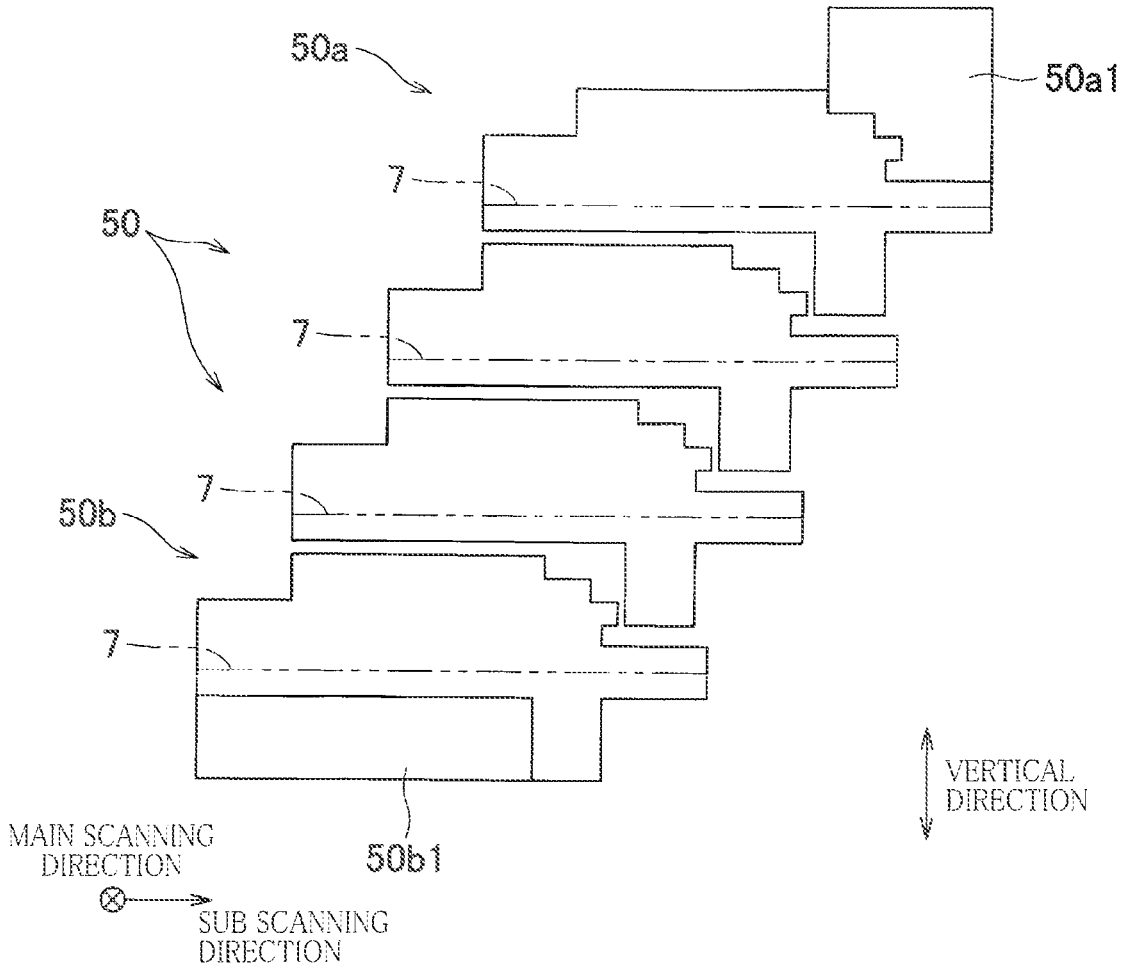
FIG. 14 is a view for explaining a layout of four recording units of a printer according to a second modified embodiment.

Referring next to FIG. 14, there will be explained a second modified embodiment. As shown in FIG. 14, another member 50*a*1 may be attached to an uppermost recording unit 50*a*, and another member 50*b*1 may be attached to a lowermost recording unit 50*b*. In this instance, a portion of the recording unit 50*a* from which another member 50*a*1 is removed and which is common to other recording units 50 or a portion of the recording unit 50*b* from which another member 50*b*1 is removed and which is common to other recording units 50 corresponds to the recording module of the present invention. Another member 50*a*1 is attached to an upper portion of the recording unit 50*a*. Another member 50*b*1 is attached to a lower portion of the recording unit 50*b*. Accordingly, the four recording units 50 are arranged in the direction E, as in the illustrated embodiment, so that the same advantages as in the illustrated embodiment are ensured. Further, the uppermost recording unit 50*a* and the lowermost recording unit 50*b* may be switched with each other. In this instance, two of the four recording units 50 interposed between the uppermost and lowermost recording units 50 can be arranged similarly to the illustrated embodiment, contributing to size reduction of the printer 1.

Figure 15:
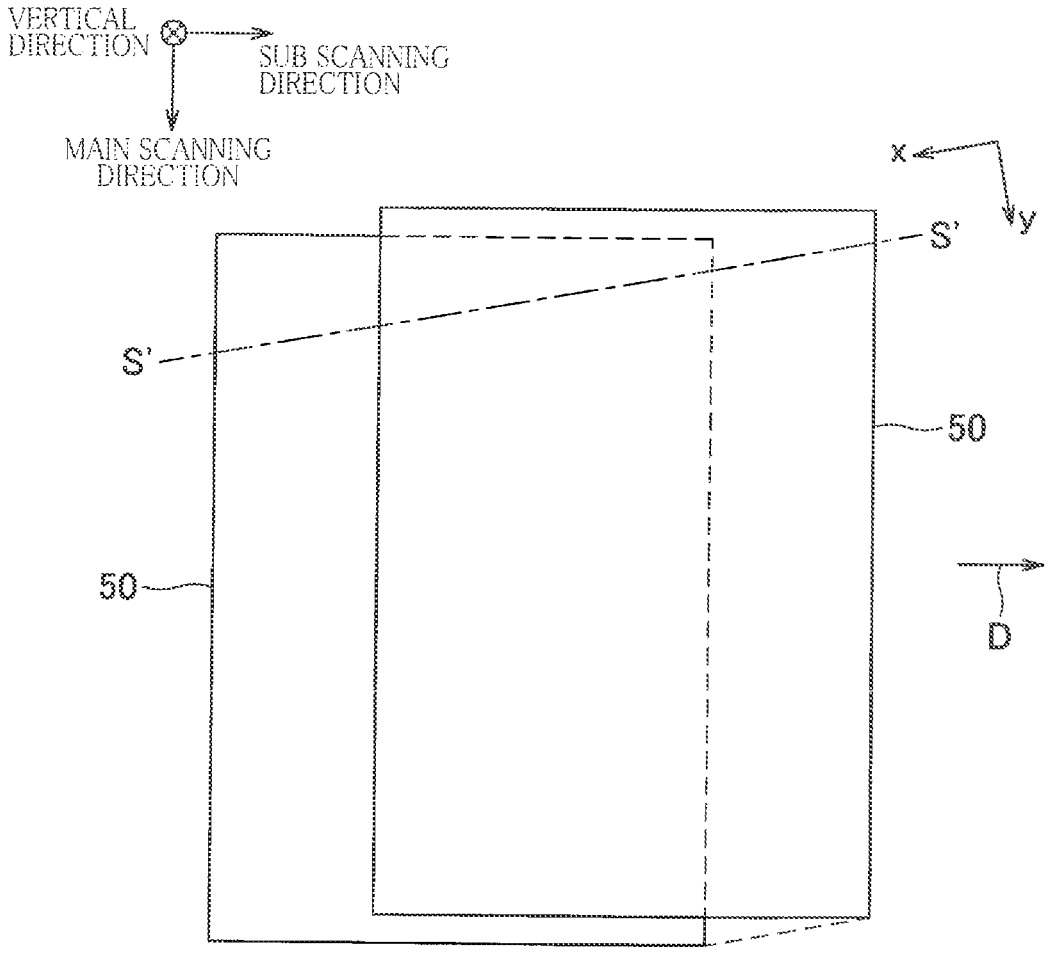
FIG. 15 is a schematic plan view of two adjacent recording units of a printer according to a third modified embodiment.
Figure 16:
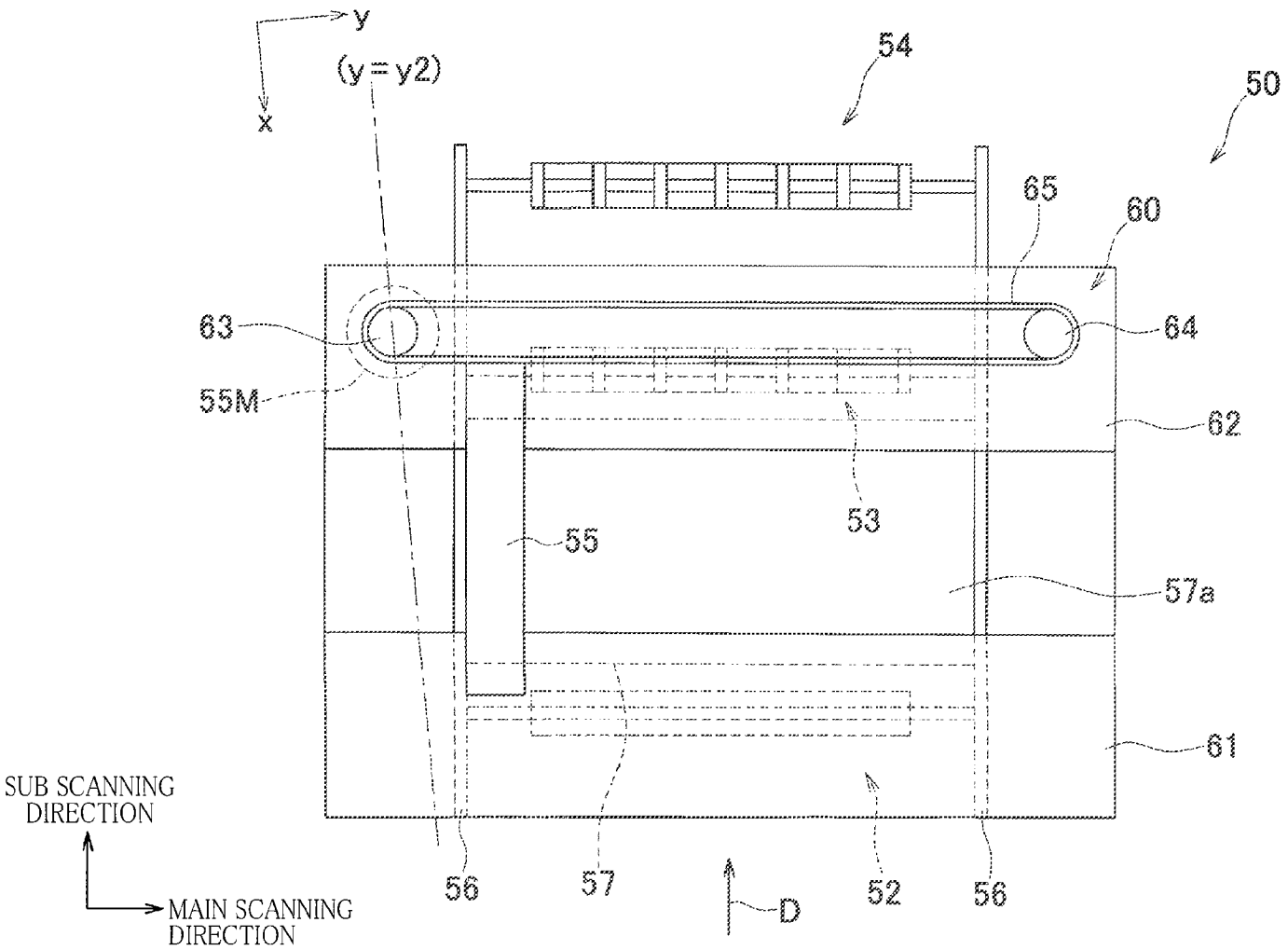
FIG. 16 is a schematic plan view of the recording unit shown in FIG. 15.
Figure 17:
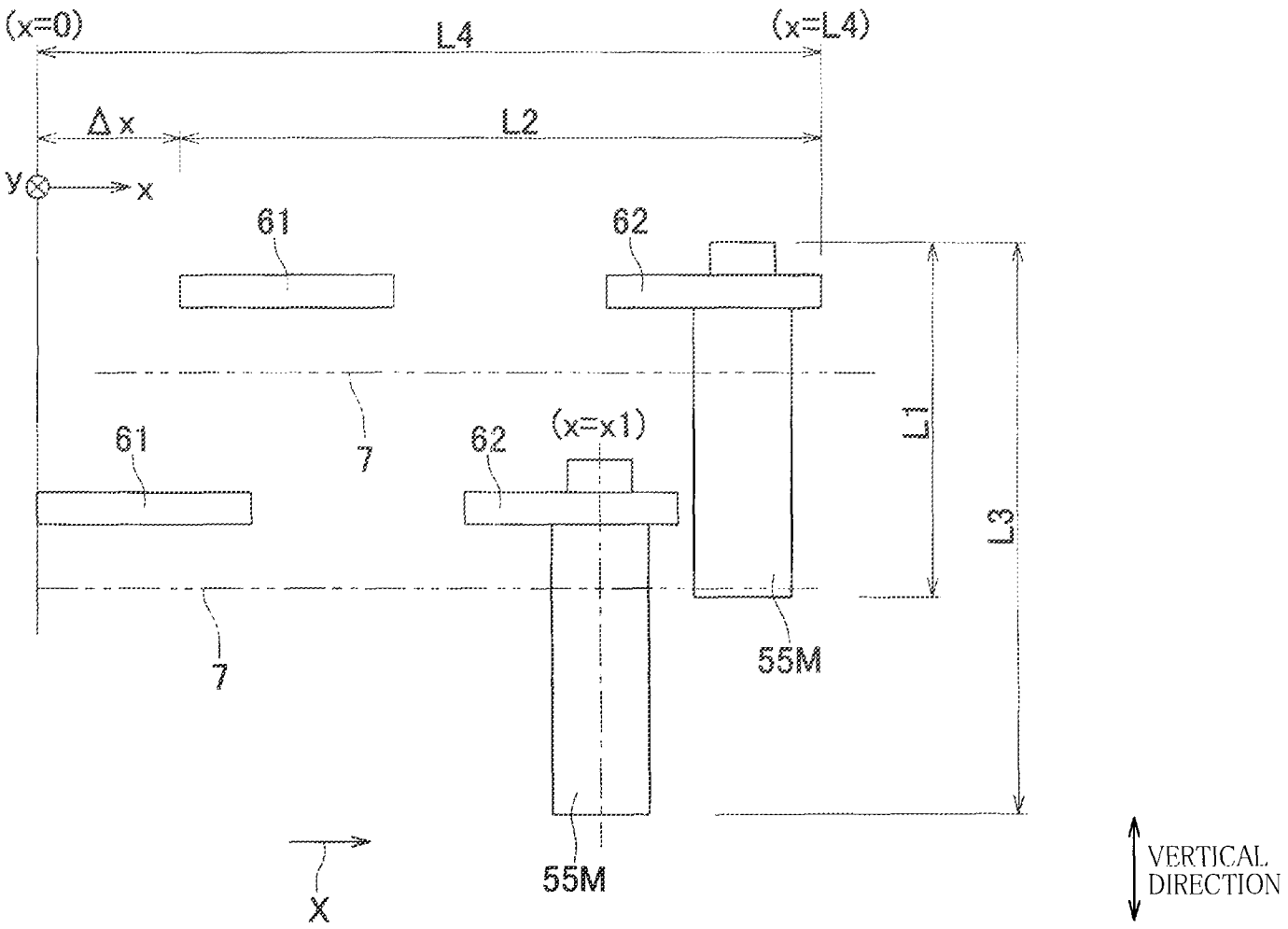
FIG. 17 is a cross-sectional view of the two adjacent recording units taken along line S'-S' in FIG. 15, namely, a cross-sectional view showing an external shape of the two adjacent recording units at a position y=y2 in FIG. 16.

Referring next to FIGS. 15-17, there will be explained a third modified embodiment. As shown in FIG. 15, any adjacent recording units 50 may be disposed so as to be shifted relative to each other not only in the sub scanning direction, but also in the main scanning direction. FIG. 15 is a view of two recording units 50 as seen in the direction orthogonal to the conveyor surface. FIG. 16 is a plan view of the recording unit shown in FIG. 15. FIG. 17 is a certain cross-sectional view taken along line S'-S' in FIG. 15. FIG. 17 is a cross-sectional view of the two recording units 50 in a plane that passes the centers of the carriage motors 55M of the respective two recording units 50 and that is orthogonal to the conveyor surface 57*a* and parallel to the direction E. More specifically, FIG. 17 is a cross-sectional view at a position y=y2 in FIG. 16. In this modified embodiment, the direction x which is a direction of projection of the direction E onto the conveyor surface does not coincide with the sheet conveyance direction D (the sub scanning direction), as shown in FIG. 16. However, where an x-axis is taken along the direction x, a y-axis is taken along a direction orthogonal to the x-axis in the conveyor surface, and a cross section shown in FIG. 17 (i.e., a cross section that is along line S'-S' in FIG. 15 and that is in a plane orthogonal to the conveyor surface and parallel to the x-axis) is considered, the same explanation as that in the illustrated embodiment is established in this cross section. That is, also in this modified embodiment, the two recording units 50 are arranged such that the dimension L3 is smaller than twice the dimension L1, the dimension L4 is smaller than twice the dimension L2, and the dimension L4 is larger than the dimension L2. Accordingly, this modified embodiment ensures advantages similar to those in the illustrated embodiment. In this third modified embodiment, the direction x intersects the sheet conveyance direction D (the sub scanning direction). Accordingly, the dimensions L2, L4 in this third modified embodiment are larger at the same ratio in the direction x than those in the illustrated embodiment.

Figure 18:
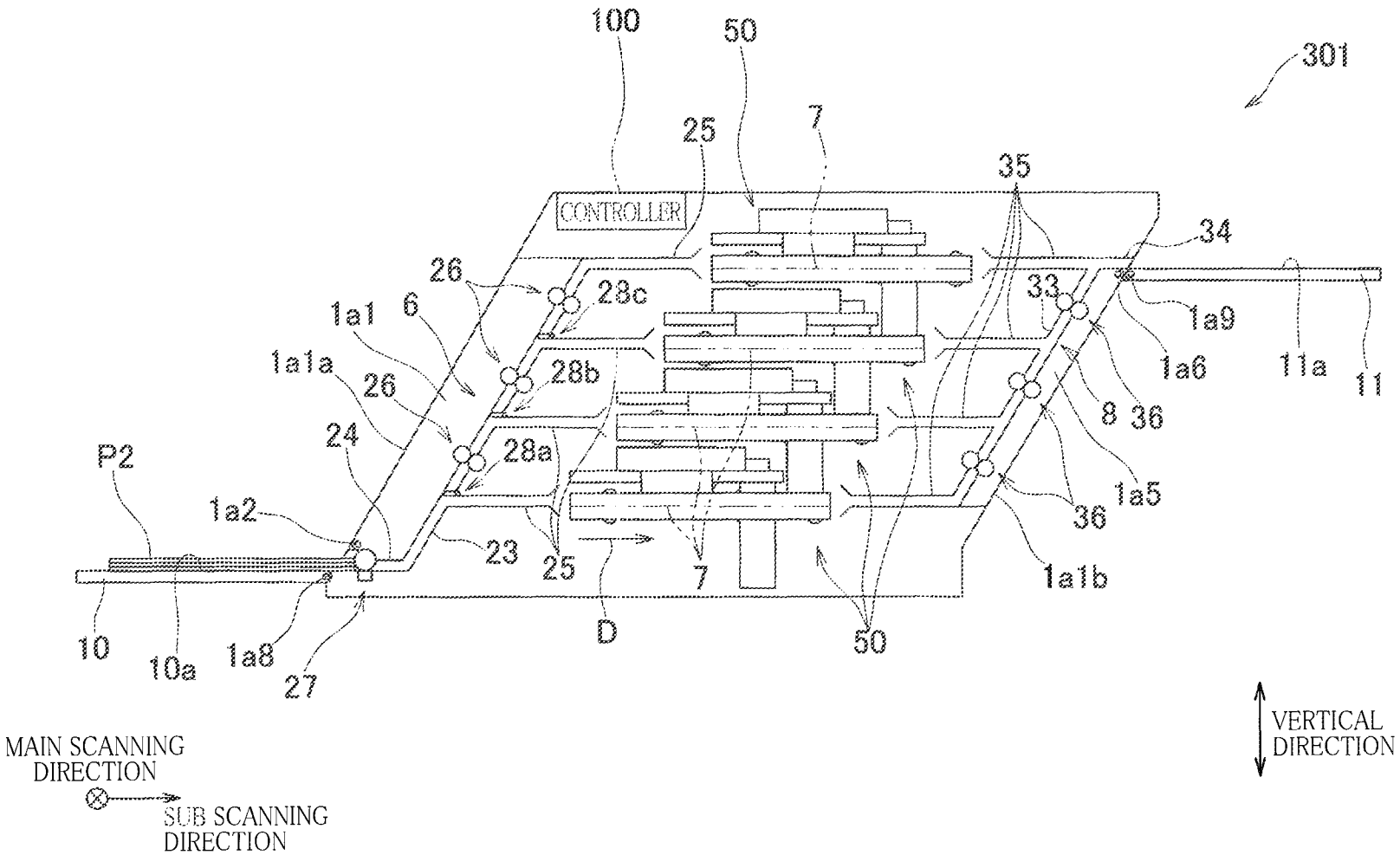
FIG. 18 is a schematic side view of a printer according to a fourth modified embodiment.

Referring next to FIG. 18, there will be explained a fourth modified embodiment. As shown in FIG. 18, the printer of the present invention may be a printer 301 configured not to have the first sheet-supply portion 3 and the first sheet-discharge portion 4. In this instance, all of the sheets P are supplied from the second sheet-supply tray 10, and all of the sheets P that have been subjected to recording in the respective recording units 50 are discharged to the second sheet-discharge tray 11. This modified embodiment ensures not only advantages similar to those in the illustrated embodiment, but also size reduction of the housing in the vertical direction.

While there have been explained embodiments of the invention, it is to be understood that the invention is not limited to the details illustrated above but may be embodied with various other changes without departing from the scope of the invention defined in the attached claims. For instance, a plurality of upstream inclined paths 6*b* may be provided such that each upstream inclined path 6*b* connects the upstream first path 6*a* and a corresponding one of the upstream second paths 6*c*. Two adjacent recording units 50 may be disposed so as to be shifted in a direction that is along the conveyor surface 57*a* and that is other than the sub scanning direction. As long as the intermediate conveyance paths 7 of respective two adjacent recording units 50 are partially parallel relative to each other, namely, as long as at least the recording regions of the respective two adjacent recording units 50 are parallel to each other, the intermediate conveyance paths 7 may be inclined relative to the horizontal direction. While the upstream inclined path 6*b* and the downstream inclined path 8*b* are inclined at the same angle in the illustrated embodiment, the upstream and downstream inclined paths 6*b*, 8*b* may be inclined at mutually different angles.

The support surface 10*a* of the second sheet-supply tray 10 and the support surface 11*a* of the second sheet-discharge tray 11 may be inclined relative to the horizontal direction. As long as the sheet P2 conveyed as described above is not bent by 90° or more at a portion of the conveyance path between the second sheet-supply tray 10 and each recording unit 50 and at a portion of the conveyance path between each recording unit 50 and the second sheet-discharge tray 11, the conveyance path may be inclined at those portions in any way within a range from larger than 90° to equal to or less than 180°. Further, the conveyance path may be inclined at the portion between the second sheet-supply tray 10 and each recording unit 50 and the portion between each recording unit 50 and the second sheet-discharge tray 11, such that the sheet P2 that is conveyed is bent by 90° or more. That is, the above-indicated angles θ1-θ4 and θ6-θ9 may be 90° or less.

The second sheet-supply tray 10 and the second sheet-discharge tray 11 may be fixed to the housing 1*a* so as not to be pivotable thereto. The upstream cover 1*a*1 and the downstream cover 1*a*5 may be fixed to the housing 1*a* such that the upstream cover 1*a*1 and the downstream cover 1*a*5 are unopenanbe. Only one of the second sheet-supply tray 10 and the second sheet-discharge tray 11 may be provided in the printer 1. It is not necessary for the sheet-supply mechanism 27 and the sheet-supply mechanism 3*b* to have a multi-feeding preventive mechanism for separating the sheets P. That is, each of the sheet-supply mechanism 27 and the sheet-supply mechanism 3*b* may be constituted merely by the sheet-supply roller. The sheet-supply mechanism 27 may have the same structure as the sheet-supply mechanism 3*b* or the sheet-supply mechanism 3*b* may have the same structure as the sheet-supply mechanism 27.

The sheet P2 that has been supplied from the second sheet-supply tray 10 may be discharged to the first sheet-discharge tray 4*a* after printing. The sheet P1 that has been supplied from the first sheet-supply tray 3*a* may be discharged to the second sheet-discharge tray 11 after printing.

The present invention is applicable to printers having line-type heads. Further, the present invention is applicable to facsimile machines, copying machines, and so on, other than the printers. Moreover, the present invention is applicable to recording apparatus of any type such as a laser type and a thermal type, as long as the recording apparatus is configured to perform image recording. The recording medium is not limited to the sheets P, but may be any recordable media.

What is claimed is:

1. A recording apparatus comprising:

a plurality of recording modules each having a conveyance path through which a recording medium is conveyed;

a recording portion configured to record an image on the recording medium that is conveyed along the conveyance path;

a connection path that is connected to the conveyance path of each of the recording modules for conveying the recording medium;

a housing in which the recording modules and the connection path are accommodated; and a first common tray connected to the connection path and having a support surface for supporting the recording medium;

wherein the recording modules are identical in external shape;

wherein, where an imaginary plane on which the recording medium is conveyed in the conveyance path is defined as a conveyor surface and a direction which is parallel to the conveyor surface and in which the recording medium is conveyed in the conveyance path is defined as a conveyance direction, the recording modules are disposed such that the conveyor surfaces of the respective recording modules are parallel to each other, and such that portions of the respective recording modules align with each other in a first direction which intersects the conveyor surface and which includes a component of the conveyance direction, the portions having the same shape;

wherein, in a certain cross section that is orthogonal to the conveyor surface and that is parallel to the first direction, where a dimension of each recording module in a second direction orthogonal to the conveyor surface is L1 and a dimension of each recording module in a third direction orthogonal to the second direction is L2, a dimension L3, in the second direction, of two recording modules among the plurality of recording modules that are adjacent in the first direction is smaller than twice the dimension L1, and a dimension L4, in the third direction, of the two recording modules is smaller than twice the dimension L2 and is larger than the dimension L2;

wherein the connection path includes an inclined path that extends in the first direction;

wherein an opposing portion of the housing has an outer surface that extends in the first direction, the opposing portion being a portion of the housing that is opposed to the inclined path in the conveyance direction; and wherein the recording modules are disposed such that a shift amount, in the conveyance direction, of one of the recording modules from a connection point of the first common tray and the connection path is larger than that of another one of the recording modules that is located nearer to the first common tray than the one of the recording modules in the first direction.

2. The recording apparatus according to claim 1;

wherein, where a portion of each recording module having the largest dimension in the second direction is defined as a first portion and a dimension, in the second direction, of the first portion is L5, a dimension L6, in the second direction, between the conveyor surfaces of the respective two recording modules is smaller than the dimension L5.

3. The recording apparatus according to claim 1;

wherein the recording modules are located at the same position in a fourth direction orthogonal to the second direction and the conveyance direction.

4. The recording apparatus according to claim 3;

wherein the first common tray and the recording modules have respective portions that are located at the same position in the conveyance direction.

5. The recording apparatus according to claim 3;

wherein the first common tray is a supply tray for supporting the recording medium to be supplied to the connection path.

6. The recording apparatus according to claim 3;

wherein the first common tray is a discharge tray for supporting the recording medium conveyed from the connection path.

7. The recording apparatus according to claim 1, further comprising:

a second common tray connected to the connection path and having a support surface for supporting the recording medium;

wherein an angle formed by any continuous two path portions in the connection path, an angle formed by the connection path and the support surface of the second common tray, and an angle formed by the connection path and the conveyance path of each of the recording modules are made larger than 90° and are not larger than 180°, such that a maximum bending angle of the recording medium that is conveyed between the second common tray and each of the recording modules is less than 90°.

8. A recording apparatus comprising:

a plurality of recording modules each having a conveyance path through which a recording medium is conveyed; and a recording portion configured to record an image on the recording medium that is conveyed along the conveyance path;

wherein the recording modules are identical in external shape;

wherein, where an imaginary plane on which the recording medium is conveyed in the conveyance path is defined as a conveyor surface and a direction which is parallel to the conveyor surface and in which the recording medium is conveyed in the conveyance path is defined as a conveyance direction, the recording modules are disposed such that the conveyor surfaces of the respective recording modules are parallel to each other, and such that portions of the respective recording modules align with each other in a first direction which intersects the conveyor surface and which includes a component of the conveyance direction, the portions having the same shape;

wherein, in a certain cross section that is orthogonal to the conveyor surface and that is parallel to the first direction, where a dimension of each recording module in a second direction orthogonal to the conveyor surface is L1 and a dimension of each recording module in a third direction orthogonal to the second direction is L2, a dimension L3, in the second direction, of two recording modules among the plurality of recording modules that are adjacent in the first direction is smaller than twice the dimension L1, and a dimension L4, in the third direction, of the two recording modules is smaller than twice the dimension L2 and is larger than the dimension L2; and wherein, where a portion of each recording module having the largest dimension in the second direction is defined as a first portion and a dimension, in the second direction, of the first portion is L5, a dimension L6, in the second direction, between the conveyor surfaces of the respective two recording modules is smaller than the dimension L5.

* * * * *